US009227199B2

(12) United States Patent
Ellis et al.

(10) Patent No.: US 9,227,199 B2
(45) Date of Patent: Jan. 5, 2016

(54) MAGNETISING PORTION FOR A MAGNETIC SEPARATION DEVICE

(75) Inventors: Darren Ellis, Lommedalen (NO); Tine Borgen Hildisch, Oslo (NO); Jeremy Mundy, Fairford (GB); Erlend Ragnhildstveit, Oslo (NO); Richard Johan Toften, Paradis (NO); Kornelija Zgonc, Carlsbad, CA (US); Malin Karlsson, Oslo (NO); Gaute Brede, Ranheim (NO); Lars Noekleby, Oslo (NO)

(73) Assignee: Life Technologies AS (NO)

( * ) Notice: Subject to any disclaimer, the term of this patent is extended or adjusted under 35 U.S.C. 154(b) by 904 days.

(21) Appl. No.: 12/601,772

(22) PCT Filed: May 29, 2008

(86) PCT No.: PCT/EP2008/056650

§ 371 (c)(1),
(2), (4) Date: Jun. 25, 2010

(87) PCT Pub. No.: WO2008/145712

PCT Pub. Date: Dec. 4, 2008

(65) Prior Publication Data

US 2010/0264090 A1 Oct. 21, 2010

Related U.S. Application Data

(60) Provisional application No. 61/014,627, filed on Dec. 18, 2007, provisional application No. 61/014,624, filed on Dec. 18, 2007, provisional application No. 60/940,614, filed on May 29, 2007, provisional application No. 60/940,629, filed on May 29, 2007.

(30) Foreign Application Priority Data

| | | |
|---|---|---|
| May 29, 2007 | (GB) | 0710188.4 |
| May 29, 2007 | (GB) | 0710189.2 |
| Dec. 14, 2007 | (GB) | 0724404.9 |
| Dec. 14, 2007 | (GB) | 0724426.2 |

(51) Int. Cl.
*B03C 1/28* (2006.01)
*B01L 9/06* (2006.01)

(52) U.S. Cl.
CPC . *B03C 1/288* (2013.01); *B01L 9/06* (2013.01); *B03C 2201/18* (2013.01); *B03C 2201/26* (2013.01)

(58) Field of Classification Search
CPC ..... B03C 1/0332; B03C 1/035; B03C 1/14; B03C 1/22; B03C 1/28; B03C 1/288; B03C 1/30; B03C 2201/18; B03C 2201/20; B03C 2201/26; B01L 9/06
USPC ..... 210/222, 223, 695; 422/527, 534; 335/306
See application file for complete search history.

(56) References Cited

U.S. PATENT DOCUMENTS

| | | | | |
|---|---|---|---|---|
| 2,358,612 | A | 9/1944 | Acker et al. | |
| 3,206,657 | A * | 9/1965 | Moriya | 335/303 |

(Continued)

FOREIGN PATENT DOCUMENTS

| | | |
|---|---|---|
| DE | 10063984 | 6/2002 |
| EP | 0136126 | 4/1985 |

(Continued)

OTHER PUBLICATIONS

CN Application No. 200880017804.5, Office Action mailed Apr. 29, 2011.

(Continued)

*Primary Examiner* — David C Mellon
(74) *Attorney, Agent, or Firm* — Life Technologies AS

(57) ABSTRACT

The present disclosure relates to a magnetizing portion for providing a high-gradient magnetic field in a magnetic separation device. The magnetizing portion comprises at least one magnetic assembly. The at least one magnetic assembly comprises: a plurality of magnets whereby each magnet has a north pole, south pole and a magnet axis extending between the north and south poles, and the plurality of magnets are arranged one above the other in a direction at least substantially perpendicular to the axis of each magnet in such a manner that the north and south poles of adjacent magnets are arranged alternately and a space is provide between adjacent magnets; and at least one non-magnetic spacing means arranged in the space between adjacent magnets. The present disclosure also relates to magnetic separation devices comprising at least one of the said magnetizing portions and to a method of isolating magnetically labelled particles using the magnetic separation devices.

23 Claims, 35 Drawing Sheets

(56) References Cited

U.S. PATENT DOCUMENTS

| | | | | | |
|---|---|---|---|---|---|
| 3,674,198 | A | | 7/1972 | Eberle | |
| 4,118,801 | A | * | 10/1978 | Kraft et al. | 366/111 |
| 4,133,466 | A | | 1/1979 | Rosen | |
| 4,883,644 | A | | 11/1989 | Perlman | |
| 4,895,650 | A | | 1/1990 | Wang | |
| 4,896,560 | A | | 1/1990 | Kato | |
| 5,036,989 | A | | 8/1991 | Carilli | |
| 5,186,827 | A | | 2/1993 | Liberti et al. | |
| 5,458,785 | A | | 10/1995 | Howe et al. | |
| 5,465,078 | A | | 11/1995 | Jones, Jr. | |
| 5,584,994 | A | * | 12/1996 | Hattori et al. | 210/195.1 |
| 5,632,388 | A | | 5/1997 | Morrison et al. | |
| 5,705,062 | A | | 1/1998 | Knobel | |
| 5,714,063 | A | * | 2/1998 | Brunsting | 210/222 |
| 5,827,478 | A | | 10/1998 | Carey et al. | |
| 5,993,665 | A | * | 11/1999 | Terstappen et al. | 210/695 |
| 6,133,037 | A | | 10/2000 | Tajima | |
| 6,187,270 | B1 | | 2/2001 | Schmitt et al. | |
| 6,193,892 | B1 | | 2/2001 | Krueger et al. | |
| 6,231,814 | B1 | | 5/2001 | Tajima | |
| 6,368,561 | B1 | | 4/2002 | Rutishauser et al. | |
| 6,514,416 | B1 | | 2/2003 | Harradine et al. | |
| 6,558,541 | B1 | | 5/2003 | Morrison | |
| 6,586,193 | B2 | | 7/2003 | Yguerabide et al. | |
| 6,743,365 | B1 | | 6/2004 | Marlowe | |
| 6,752,967 | B2 | | 6/2004 | Farina et al. | |
| 7,326,350 | B2 | | 2/2008 | Mueller et al. | |
| 2001/0007312 | A1 | | 7/2001 | Siddiqi | |
| 2002/0182751 | A1 | | 12/2002 | Herr et al. | |
| 2003/0049841 | A1 | | 3/2003 | Short et al. | |
| 2003/0134416 | A1 | | 7/2003 | Yamanishi et al. | |
| 2004/0142384 | A1 | | 7/2004 | Cohen et al. | |
| 2004/0142463 | A1 | | 7/2004 | Walker et al. | |
| 2004/0265903 | A1 | | 12/2004 | Mueller et al. | |
| 2005/0123445 | A1 | | 6/2005 | Blecka et al. | |
| 2008/0190458 | A1 | | 8/2008 | Garcia Gros et al. | |
| 2010/0264090 | A1 | | 10/2010 | Ellis et al. | |
| 2010/0294706 | A1 | | 11/2010 | Simonson | |
| 2011/0031168 | A1 | | 2/2011 | Ellis et al. | |

FOREIGN PATENT DOCUMENTS

| | | |
|---|---|---|
| EP | 0381964 | 8/1990 |
| EP | 0704244 | 5/1996 |
| EP | 1580555 | 9/2005 |
| EP | 1655071 | 5/2006 |
| GB | 2129551 | 5/1984 |
| JP | 8304399 | 11/1996 |
| WO | WO90/14891 | 12/1990 |
| WO | WO92/16844 | 10/1992 |
| WO | WO93/22686 | 11/1993 |
| WO | WO99/20397 | 4/1999 |
| WO | WO99/59708 | 11/1999 |
| WO | WO2008/145709 | 12/2008 |
| WO | WO2008/145711 | 12/2008 |
| WO | WO2008/145712 | 12/2008 |

OTHER PUBLICATIONS

GB Application No. 0710189.2, Search Report mailed Aug. 31, 2007.
GB Application No. 0710188.4, Search Report mailed Sep. 11, 2007.
GB Application No. 0724426.2, Search Report mailed Apr. 14, 2008.
GB Application No. 0724404.0, Search Report mailed Apr. 9, 2008.
International Application No. PCT/EP2008/056645, Invitation to Pay Add'l Fees and Partial Search Report Mailed on Nov. 5, 2008.
International Application No. PCT/EP2008/056650, International Search Report and Written Opinion mailed on Nov. 3, 2009.
International Application No. PCT/EP2008/056649, International Preliminary Examination Report mailed Dec. 29, 2008.
International Application No. PCT/EP2008/056649, Written Report mailed Dec. 23, 2008.
International Application No. PCT/EP2008/056649, International Search Report mailed Dec. 23, 2008.

* cited by examiner

MAGNETISING PORTION FOR A MAGNETIC SEPARATION DEVICE

The present application is the national stage filing of International Application No. PCT/EP2008/056650, filed May 29, 2008, which claims priority to United Kingdom Patent Application No. GB0710188.4, filed May 29, 2007; United Kingdom Patent Application No. GB0710189.2, filed May 29, 2007; U.S. Provisional Application No. 60/940,629, filed May 29, 2007; U.S. Provisional Application No. 60/940,614, filed May 29, 2007; United Kingdom Patent Application No. GB0724426.2, filed Dec. 14, 2007; United Kingdom Patent Application No. GB0724404.9, filed Dec. 14, 2007; U.S. Provisional Application No. 61/014,624, filed Dec. 18, 2007; and U.S. Provisional Application No. 61/014,627, filed Dec. 18, 2007; all of which are hereby incorporated by reference.

FIELD OF DISCLOSURE

This disclosure relates to a magnetising portion suitable for a magnetic separation device. The magnetising portion provides a high-gradient magnetic field that can attract and separate magnetically labelled particles from a non-magnetic medium in which they are contained. The disclosure also relates to a magnetic separation device for isolating magnetically labelled particles, the device comprising the said magnetising portion.

BACKGROUND

The use of a high-gradient magnetic field to attract and separate magnetically labelled particles from a fluid in which they are suspended is well known. Moreover, magnetic separation devices are used in a variety of industries including pharmaceutical, medical, agricultural, scientific and engineering fields. For example in biotechnology, a high-gradient magnetic field may be used to separate magnetically labelled bone marrow cells from a blood sample.

A high-gradient magnetic field is conventionally created by configuring magnets to provide a magnetic field with regions of high magnetic field density and regions of low magnetic field density. The gradient of the magnetic field is the variation in field strength between the high density regions and low density regions.

European Patent Application No 03819654 describes how a magnetic material may be used for collecting micrometer sized magnetic particles (preferably in the range of 0.1 to 2 μm). The magnetic material includes a plurality of magnets. Each magnet has a north pole and a south pole. The magnets are stacked one above the other in such a manner that the adjacent magnets are in contact with one another and the north poles (N) and south poles (S) of adjacent magnets are arranged alternately (i.e. the north pole (N) of a each magnet is arranged adjacent to the south pole (S) of an adjacent magnet). In order to collect magnetically labelled particles, the magnetic material is placed proximate a sample vessel such that a sample comprising magnetically labelled particles is subject to a "fringe" magnetic field (i.e. a magnetic field extending around the periphery of the magnetic material between opposing poles). It has been found that the strength and gradient of the fringe magnetic field is compromised as a result of placing magnets in contact with one another. The strength of the fringe magnetic field is limited because the return flux travels directly through the contacting adjacent magnets to the opposite poles rather than travelling outwardly around the periphery of the magnets towards the opposite poles of adjacent magnets. Since the strength of the fringe field is limited, the variation in field strength between the high magnetic field density regions and low magnetic field density regions of the fringe field is restricted. As a direct consequence, the gradient of the fringe magnetic field is minimised. The performance of the magnetic material is compromised as a result of placing the magnets in contact with one another. For example, the magnetic material may not be able to isolate the smallest micrometer sized particles and will be unsuitable for isolating nanometer sized particles. The efficiency and accuracy of the separation process will also be restricted.

U.S. patent application Ser. No. 10/484,110 describes a system for separating magnetically attractable micrommeter sized particles (preferably in the range of 1.5 to 4 μm) which are suspended in a liquid. The system includes a magnet arrangement that comprises at least two magnets in ring form. In a first embodiment of the system the magnet axis (Y-Y') is orientated perpendicular to the ring plane and the magnets are arranged one above another in the same direction so that the north-south axes (Y-Y') face in the same direction. The inner portions of the ring magnets form a space for receiving a sample vessel. FIG. 1*a* depicts a magnetic arrangement (15) comprising three ring magnets (10,10',10") arranged in the same direction. Non-magnetic spacers (11,11') are arranged between adjacent ring magnets. A sample vessel (20) is arranged within a receiving space (12) of the magnet arrangement. FIG. 1*b* depicts the magnetic field generated by the magnet arrangement shown in FIG. 1*a*. The magnetic field acting within the receiving space is a fringe magnetic field (25). It is clear from the lines of magnetic flux shown in FIG. 1*b* that the magnetic field acting within the receiving space is a weak fringe magnetic field with a low gradient. The magnetic field is weak and has a low gradient due to the configuration of the ring magnets. The ring magnets are configured such that the magnetic flux travels directly through the magnets towards opposing poles rather than outwardly around the periphery of the magnets within the receiving space. Also, significant magnetic flux extends through the top and bottom pole faces rather than within the receiving space. Non-magnetic spacers provided between the ring magnets are intended to help create regions of low magnetic field density within the ring space. However, the spacers have very little effect on the gradient of the fringe field because the fringe field is already so weak. Since the fringe magnetic field is poor the efficiency and accuracy of the separation process is compromised. The size of particles that can be separated by the magnet arrangement is also restricted. More particularly, the magnet arrangement will be unsuitable for isolating smaller (nanommeter sized) magnetically labelled particles.

In a second embodiment of the system described in U.S. patent application Ser. No. 10/484,110 the ring magnets are arranged in opposite directions so that the north-south axes (Y-Y') of adjacent magnets are in opposite directions. FIG. 2*a* depicts a magnet arrangement (15') comprising three ring magnets (10,10',10") arranged in opposite directions. Non-magnetic spacing means (11,11') are arranged between adjacent magnets. FIG. 2*b* depicts the magnetic field generated by the magnet arrangement of FIG. 2*a*. FIG. 2*c* depicts a graph showing how the magnetic field strength in the centre of the receiving space (12) varies along the central longitudinal axis (X-X') of the magnet arrangement. It is clear from the flux lines of FIG. 2*b* that a stronger and higher gradient fringe magnetic field is generated within the receiving space when the ring magnets are arranged in opposite directions. This is because more magnetic flux is directed outwardly within the receiving space due to the repelling poles. The non-magnetic spacing means help to create regions of low magnetic field density within the receiving space. Due to the increased magnetic flux and use of non-magnetic spacing means the difference in the field strength between the regions of high magnetic field density and low magnetic field density is greater than in the first embodiment. Therefore, the gradient of the fringe magnetic field is higher than in the first embodiment. Nevertheless, the field strength and gradient of the fringe magnetic field acting within the receiving space is still restricted because significant magnetic flux continues to extend through the top and bottom pole faces of the ring magnet arrangement rather than within the receiving space. Moreover, the performance of the magnet arrangement is not constant along the longitudinal axis of the receiving space. It can be seen in FIGS. 2*b* and 2*c* that the peak strength of the fringe magnetic field acting in the receiving space between the top magnet (10) and the peak strength of the fringe magnetic field acting in the receiving space between the bottom magnet (10") is weaker than the peak strength of the fringe magnetic field acting in the receiving space between the middle magnet (10'). The peak strength of the fringe magnetic field varies along the longitudinal axis of the receiving space due to the configuration of the repelling poles. Since the peak strength varies, the gradient of the fringe magnetic field also varies along the longitudinal axis of the receiving space. As a direct consequence, the performance of the magnet arrangement is not consistent along the longitudinal axis of the receiving space the efficiency and accuracy of the separating process is compromised.

Accordingly, there is a need to provide a magnetic separation device that can alleviate and/or overcome at least some of the above-mentioned problems. More specifically, the invention seeks to provide a magnetising portion that generates a high-gradient magnetic field suitable for isolating any size of magnetically labelled particles, including nanommeter sized particles. The invention seeks to reduce the separation time by providing a magnetising portion with a high-gradient magnetic field suitable for attracting and separating magnetically labelled particles quickly. The present invention also seeks to provide a magnetising portion that produces a high-gradient magnetic field with at least a substantially constant performance.

BRIEF SUMMARY OF THE DISCLOSURE

A first aspect of the present disclosure relates to a magnetising portion for providing a high-gradient magnetic field in a magnetic separation device. The magnetising portion comprises at least one magnetic assembly. The at least one magnetic assembly comprises:

a plurality of magnets whereby each magnet has a north pole, south pole and a magnet axis extending between the north and south poles, and the plurality of magnets are arranged one above the other in a direction at least substantially perpendicular to the axis of each magnet in such a manner that the north and south poles of adjacent magnets are arranged alternately and a space is provide between adjacent magnets; and at least one non-magnetic spacing means arranged in the space between adjacent magnets.

Preferably the non-magnetic spacing means comprises aluminium or a plastics material. Alternatively, the non-magnetic spacing means is an air gap.

Preferably the magnets comprise a permanent magnetic material or a ferrous magnetic material.

Preferably each magnet comprises a first pole surface and a second pole surface, and the first pole surface and/or the second pole surface of at least one of the magnets is shaped to follow the contour of a sample vessel.

Preferably, the magnetising portion is configured such that, in use, the at least one magnetic member may be arranged proximate at least one sample vessel. More particularly, the magnetising portion may comprise a first magnetic member and a second magnetic member that are configured such that, in use, they may be arranged in parallel relation on opposite sides of and proximate a sample vessel.

The magnetising portion may comprise a plurality of magnetic members mounted in a substantially radial array. Alternatively, the magnetising portion may comprise a plurality of magnetic members mounted in a substantially linear array.

A second aspect of the invention relates to a magnetic separation device for isolating magnetically labelled particles. The magnetic separation device comprises:

a body portion having an array of sample vessel retaining portions, and a plurality of magnetising portions according to the first aspect, whereby the plurality of magnetising portions are arranged within the body portion such that at least two magnetic members are circumferentially spaced about each sample vessel retaining portion.

A third aspect of the invention relates to a further magnetic separation device for isolating magnetically labelled particles. This particular magnetic separation device comprises:

a body portion having a magnetising portion according to the first aspect, for providing a high-gradient magnetic field and a surface by means of which the body portion may stand on a supporting surface, a sample vessel retaining portion for retaining at least one sample vessel, wherein the sample vessel retaining portion is configured to retain at least one sample vessel such that at least one portion of the contents of the sample vessel is visible to the user; and the sample vessel retaining portion is configured to be mountable on the magnetising portion so that in use, the at least one sample vessel retaining portion is subject to the high-gradient magnetic field of the magnetising portion.

A fourth aspect of the invention relates to a method of isolating magnetically labelled particles from a magnetic medium using the magnetic separation devices of the second aspect or the third aspect of the invention, the method comprising the steps of:

(i) mounting at least one sample vessel, containing a sample having magnetically labelled particles, in a sample vessel retaining portion;

(ii) subjecting the sample having magnetically labelled particles to the high-gradient magnetic field of the magnetising portion;

(iii) removing the non-magnetic supernatant.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

BRIEF DESCRIPTION OF THE DRAWINGS

For a better understanding of the present disclosure and to show how it may be carried into effect, reference will be made, by way of example only to the following drawings in which.

DETAILED DESCRIPTION

The Magnetising Portion

Figure 1A:
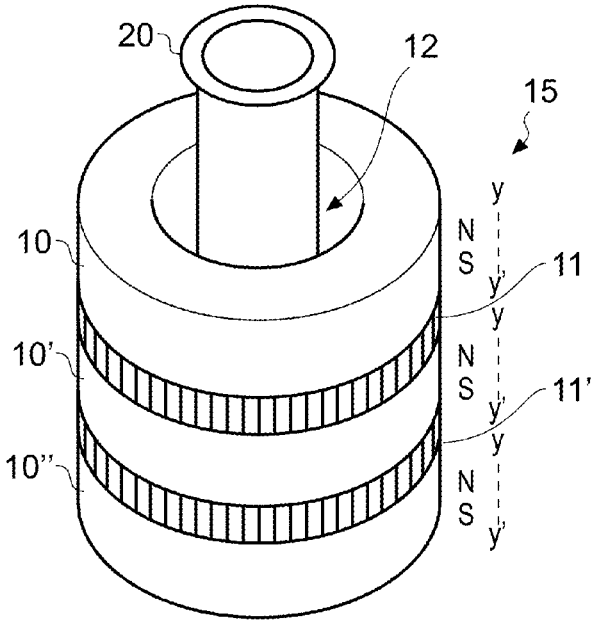
FIG. 1*a* is a perspective view of a first embodiment of a prior art magnet arrangement.
Figure 1B:
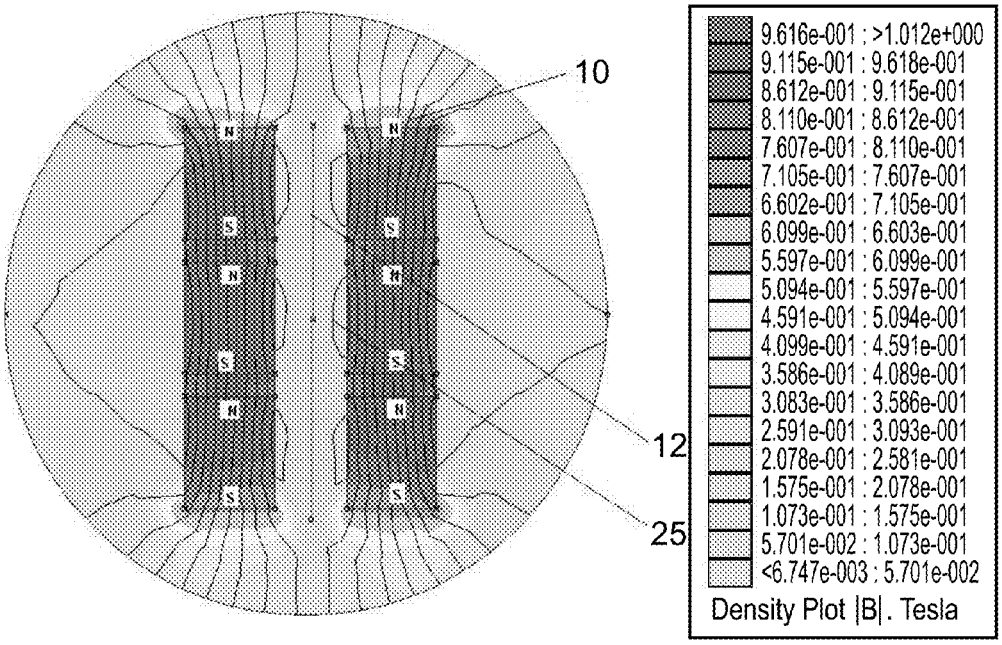
FIG. 1*b* depicts the magnetic field generated by the magnet arrangement of FIG. 1*a;*
Figure 2A:
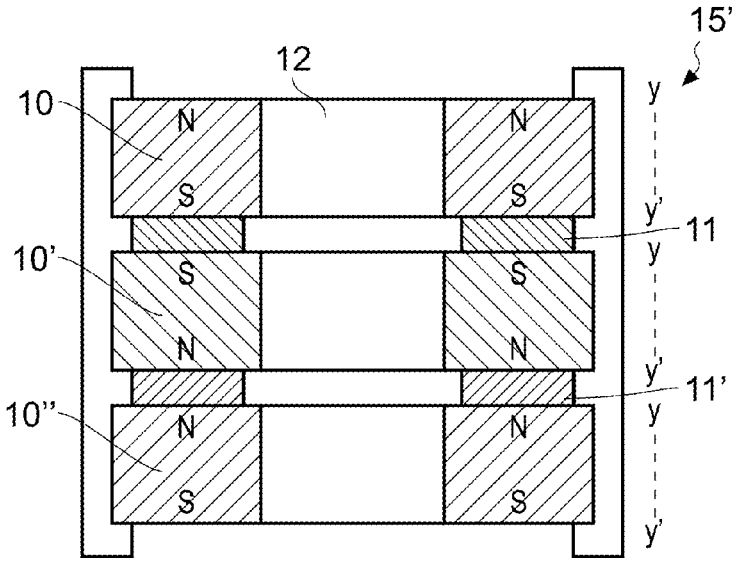
FIG. 2*a* is a side-view of a second embodiment of a prior art magnet arrangement.
Figure 2B:
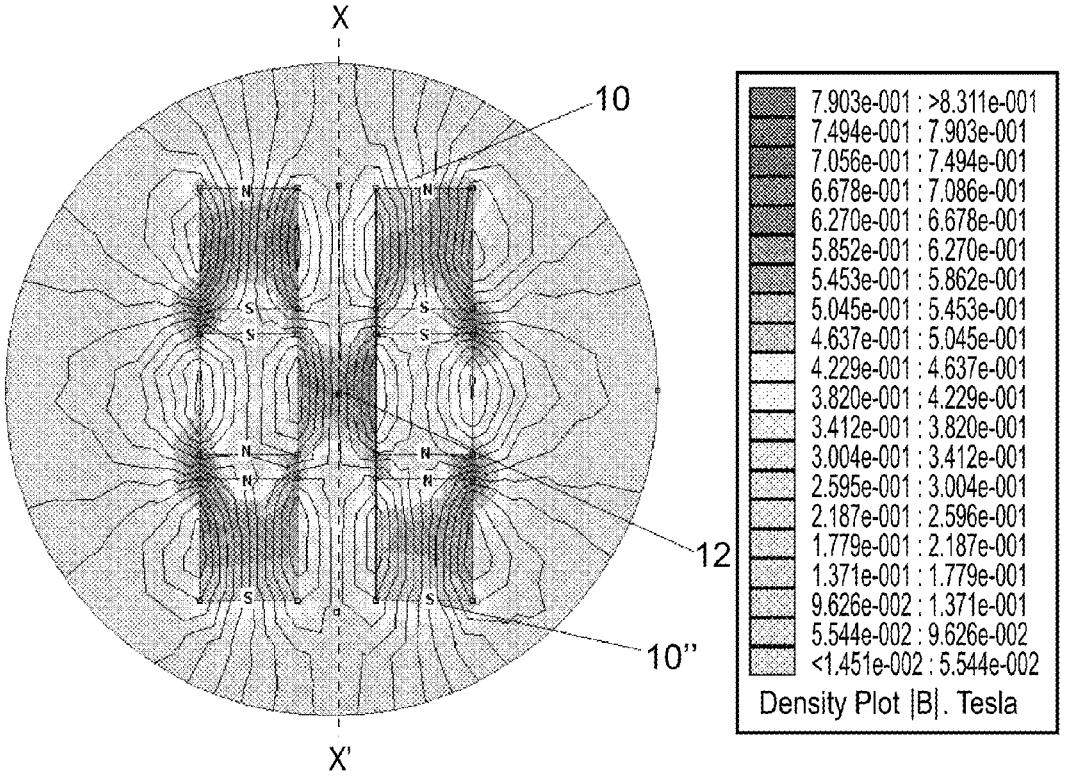
FIG. 2*b* depicts the magnetic field generated by the magnet arrangement of FIG. 2*a;*
Figure 2C:
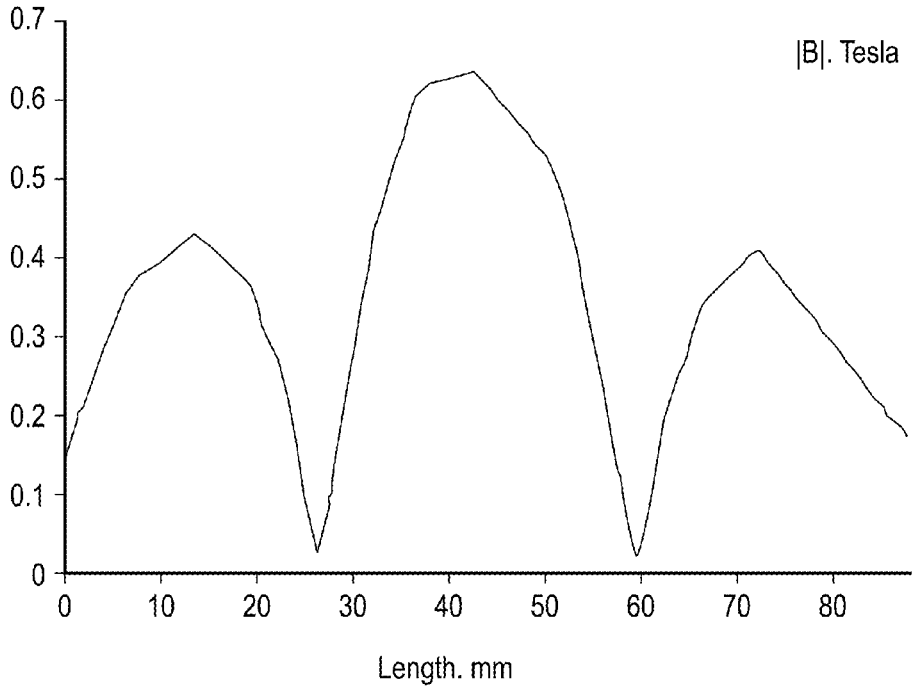
FIG. 2*c* is a graph showing how the magnetic field strength varies along the central longitudinal axis of the magnet arrangement of FIG. 2*a;*

Referring now to FIGS. 3 to 6*b*, the magnetising portion (3) suitable for a magnetic separation device comprises at least one magnetic assembly (3*m*). The at least one magnetic assembly (3*m*) comprises a plurality of magnets (M) and at least one non-magnetic spacing means (SP) arranged between adjacent magnets (M).

The magnetising portion (3) provides a high-gradient magnetic field that is suitable for attracting and separating magnetically labelled particles from a fluid in which they are contained.

Each magnet (M) of the at least one magnetic assembly (3*m*) has a north pole (N), south pole (S) and a magnet axis (Y-Y') that extends between a north pole end face and a south pole end face. The magnets in the magnetic member are arranged, in parallel, one above the other in a "stacked" formation. The magnets are stacked in a direction that is at least substantially perpendicular to the magnet axis (Y-Y') of each magnet. The magnetic assembly has a longitudinal axis (Z-Z') that extends between the top magnet and the bottom magnet of the stacked formation. It can be seen in FIGS. 3, 4*a*, 5*b*, 6*a* & 6*b* that the magnets (M) are arranged in parallel such that the magnet axis (Y-Y') of each magnet (M) extends in a substantially horizontal direction and the magnets (M) are stacked one above the other such that the longitudinal axis (Z-Z') of the magnetic assembly extends in a substantially vertical direction.

The magnets (M) of the at least one magnetic assembly (3*m*) are arranged with respect to one another in the stacked formation so as to provide an alternating multipole configuration. In the alternating multipole configuration, the north and south poles are arranged in an alternating pattern. The alternating multipole configuration is achieved by arranging the magnets such that the north pole of each magnet is arranged adjacent the south pole of the adjacent magnet. For example, when a magnetic assembly comprises two magnets, the north pole of the first magnet is arranged adjacent the south pole of the second magnet and the south pole of the first magnet is arranged adjacent the north pole of the second magnet—see FIGS. 3 and 6*b*.

The magnets (M) of the at least one magnetic assembly (3*m*) are arranged in a spaced relationship within the stacked formation such that there is a space or void between adjacent magnets. (The magnets are not arranged in contact with one another and the surfaces of adjacent magnets do not touch.) The adjacent magnets are spaced apart by a predetermined distance in a direction that is substantially parallel to the longitudinal axis (Z-Z') of the magnetic assembly and substantially perpendicular to the axis (Y-Y') of each magnet.

The magnets (M) of the at least one magnetic assembly (3*m*) may be made of a ferrous magnetic material such as iron, steel or any other suitable ferrous material. The magnets may alternatively be made from a permanent magnetic material such as ferrite, samarium cobalt or any other suitable permanent material. Preferably, the permanent magnets may be formed from a high performance rare earth alloy such as neodymium iron boron (NdFeB). In an alternative embodiment of the disclosure, the magnets may be electromagnets.

The ferromagnetic or permanent magnets may be rod, plate, bar or cube shaped and have a first pole end face (or surface) and a second pole end face (or surface). The ferromagnetic or permanent magnets preferably have substantially flat pole end faces (FEF) as shown in FIGS. 3, 4*a*, 5*b* and 6*b*. However, the pole end face may be shaped to follow the contour of the sample vessels. For example, the pole end face of a magnet may be inclined (IEF) to follow the contour of a sample vessel as shown in FIGS. 5*b* and 6*b*. It has been found that the effects of a high-gradient magnetic field are further enhanced if the magnets are shaped to follow the contour of the sample vessels, particularly smaller sample vessels.

The number, size and type of magnets stacked within a magnetic assembly can be selected in accordance with the high-gradient magnetic field required to isolate the magnetically labelled particles from a non-magnetic medium, the size of the sample vessel and the region of the sample vessel to be subjected to the high-gradient magnetic field.

At least one non-magnetic spacing means (SP) is arranged in the spaces or voids between the adjacent magnets (M) of a magnetic assembly (3*m*). See FIGS. 3, 4*a*, 5*b*, 6*a* and 6*b*. Preferably, the spacing means (SP) at least substantially fill the spaces or voids between the adjacent magnets. The spacing means (SP) are made of a material or materials that are non-magnetic. For example, the spacing means (SP) may be made of a plastics material or aluminium. Alternatively, the spacing means may be an air gap.

The at least one non-magnetic spacing means is provided to adjust the intensity and spatial distribution of the magnetic field. Since the non-magnetic spacing means is made from a non-magnetic material or materials the flow of magnetic flux is restricted by the spacing means. Given that little or no magnetic flux is able to travel through a non-magnetic spacing means a region of low magnetic field density is created between adjacent magnets. Hence, the at least one non-magnetic spacing means adjusts the magnetic field by creating a region of low magnetic field density within the magnetic field.

The number, material/materials and thickness of the non-magnetic spacing means arranged between the adjacent magnets are determined in accordance with the magnetic field generated by the magnets and the magnetic field adjustment required, so as to provide a suitable high-gradient magnetic field.

Figure 3:
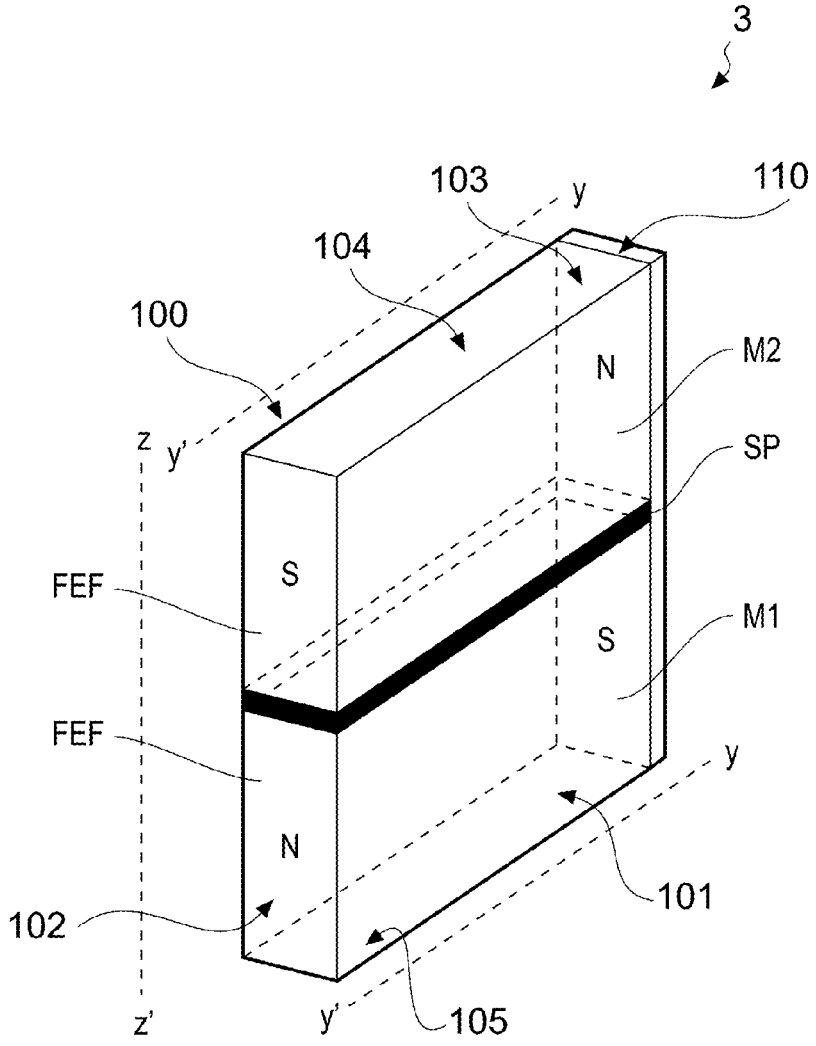
FIG. 3 is a perspective view of a first embodiment of a magnetising portion according to the disclosure.

Due to the configuration of the magnets (M) and non-magnetic spacing means (SP), the magnetic assembly (3*m*) has a cuboid-like shape with two side walls (100, 101), two end faces (102,103), an upper surface (104) and a lower surface (105). Due to the alternating multipole configuration of the magnets, the first end face 102 of the magnetic assembly comprises a first alternating multipole surface and the second (opposing) end face 103 of the magnetic assembly comprises a second alternating multipole surface. See FIGS. 3 and 6*b*. Clearly, the configuration of the alternating poles in the first surface is the reverse of or opposite to the configuration of the alternating poles in the second surface. The magnetic field of an alternating multipole surface may be restricted by mounting a pole piece or backing plate (110) adjacent the surface, as shown in FIG. 3.

The magnets (M) and non-magnetic spacing means (SP) of the magnetic assembly may be mounted and retained in a stacked formation using any suitable mounting means. For example, the magnets (M) and non-magnetic spacing means (SP) may be mounted within a housing (magnetic assembly housing) which defines a void, cavity or chamber for receiving a plurality of magnets and at least one non-magnetic spacing means. The housing is provided to retain the magnets (M) and spacing means (SP) in a stacked formation and protect the magnetic assembly. The housing may be provided to prevent corrosion, damage or fluid contact with the magnets. Clearly the housing must be made from a non-magnetic material or materials. The housing is preferably easy to clean and resistant to disinfectant and/or other aggressive chemicals. Alternatively, the magnets (M) and non-magnetic spacing means (SP) of the magnetic assembly may be mounted and retained using non-magnetic clamping means.

As indicated above, the magnetising portion may comprise one or more magnetic assembly. In use, one or more magnetic assemblies may be arranged proximate one or more sample vessels. For example, the magnetising portion may comprise a single magnetic assembly with a first alternating multipole surface whereby, in use, the magnetic assembly is arranged with respect to a single vessel such that the first alternating multipole surface is proximate a single sample vessel. The magnetising portion may comprise a magnetic assembly with a first multipole alternating surface and a second alternating multipole surface whereby, in use, the magnetic assembly is arranged with respect to two sample vessels such that the first alternating multipole surface is proximate a first sample vessel and the second alternating multipole surface is proximate a second sample vessel. The magnetising portion may comprise a plurality of magnetic assemblies whereby, in use, the magnetic assemblies are arranged with respect to a single sample vessel such that an alternating multipole surface of each magnetic member is proximate the sample vessel.

Figure 5A:
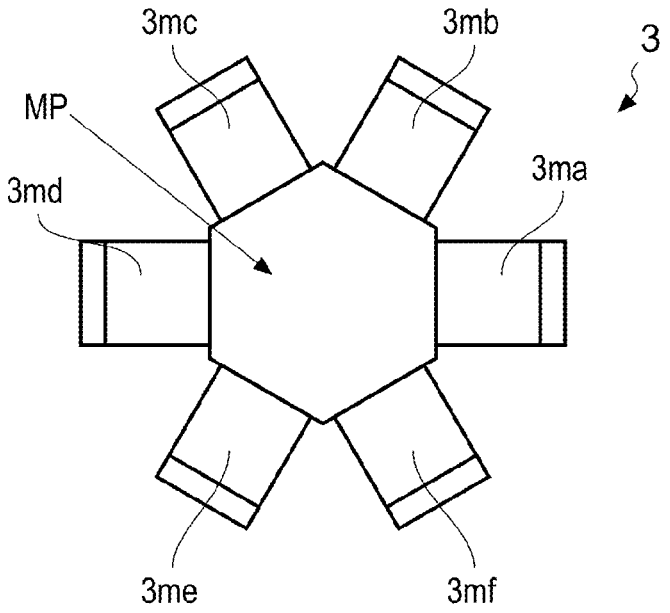
FIGS. 5*a* and 5*b* are a plan-view and side-view respectively of a third embodiment of a magnetising portion according to the disclosure.

The magnetising portion may comprise a plurality of magnetic assemblies arranged in a substantially radial or circumferential configuration—see FIGS. 5*a* and 5*b*. Alternatively, the magnetising portion may comprise a plurality of magnetic assemblies arranged in a substantially linear configuration—see FIGS. 6*a* and 6*b*.

When the at least one magnetic assembly is arranged proximate at least one sample vessel, the at least one magnetic assembly is preferably arranged such that the longitudinal axis (Z-Z') of the magnetic assembly is substantially parallel to the longitudinal axis of the at least one sample vessel. The at least one magnetic assembly is conventionally arranged such that at least a main volume of the at least one sample vessel is subject to a high-gradient magnetic field. Additionally or alternatively, the at least one magnetic assembly is arranged such that a tip of the at least one sample vessel is subject to a high-gradient magnetic field.

The number, size and configuration of the magnetic assembly can be selected in accordance with the high-gradient magnetic field required to isolate the magnetically labelled particles from a non-magnetic medium, the configuration of the magnetic separation device, the arrangement of the sample vessels within the magnetic separation device and the type (size and shape) of sample vessels.

The one or more magnetic assembly may be mounted and retained using any suitable mounting means. For example, a plurality of magnetic assemblies may be mounted in a in a substantially linear configuration or a substantially circumferential configuration about a magnetic assembly mounting portion. See FIGS. 5*a* to 6*b*. Alternatively or additionally, the one or more magnetic assembly may be mounted in a housing (H) which defines a void, cavity or chamber for receiving the one or more magnetic assembly. See FIG. 6*a*. At least one magnetic assembly may be further or alternatively mounted and retained using clamping means. Clearly the mounting means must be made from a non-magnetic material or materials. The mounting means is preferably easy to clean and resistant to disinfectant and/or other aggressive chemicals.

As mentioned previously, the magnetising portion is configured such that it is suitable for use with a number of different types, sizes and shapes of sample vessels. The sample vessel may be a sample vessel of any conventional size, typically having a diameter up to 30 mm and volume ranging from about 5 to 50 ml. The sample vessel may be a test-tube, for example a "Falcon" test-tube available under the Falcon brand from B. D Falcon, New Jersey, USA or a "flow" test-tube such as cytometry tubes also available from B. D. Falcon. Alternatively the sample vessels may be smaller vessels, for example 0.5 to 2.0 ml micro-centrifuge tubes available from Eppendorf A. G. Hamburg, Germany.

The Superior High-Gradient Magnetic Field of the Magnetising Portion

It has been found that the magnetising portion (3) of the present disclosure provides a high-gradient magnetic field that is surprisingly superior with respect to the prior art. It seems that the magnets (M) and non-magnetic spacing means (SP) interact unexpectedly to provide an enhanced high-gradient magnetic field.

The high-gradient magnetic field produced by the magnetising portion (3) of the present disclosure has a surprisingly better gradient than the prior art. The magnetic field has a better gradient because the magnets (M) and non-magnetic spacing means (SP) interact to provide regions of higher magnetic field density and regions of lower magnetic field density than the prior art.

Due to the higher gradient, the magnetic field is able to isolate very small magnetically labelled particles including nanommeter sized particles. The magnetic field is also able to isolate magnetically labelled particles more rapidly and accurately.

The performance of the high-gradient magnetic field produced by the magnetising portion (3) of the present disclosure is surprisingly more constant than the prior art. The performance of the high-gradient magnetic field is more constant because the magnets (M) and non-magnetic spacing means (SP) interact to provide a magnetic field that varies in a substantially regular and consistent fashion along the longitudinal axis (Z-Z') of the magnetic assembly. The magnetic field varies in a substantially regular and consistent manner because the alternate high density regions and low density regions are substantially equally spaced and each high density region has substantially the same maximum or "peak" value and each low density region has substantially the same minimum value.

Due to the constancy of performance, the performance (or effects) of the high-gradient magnetic field along the longitudinal axis (Z-Z') of the magnetic assembly is at least substantially the same. A high-gradient magnetic field with a more constant performance is able to isolate magnetically labelled particles more accurately and efficiently. For example, the high-gradient magnetic field is able to attract and separate particles from all parts of the sample fluid subject to the magnetic field.

When the magnetising portion (3) is arranged with respect to at least one sample vessel such that an alternating multipole surface of at least one magnetic assembly is proximate the least one sample vessel, the magnetically labelled particles suspended within a sample are attracted by the at least one magnetic assembly and immobilised at selected regions along the interior surface of the sample vessel. These selected regions are sections or zones of the interior surface of the sample vessel adjacent the alternating multipole surface of the at least one magnetic assembly. The sections or zones along of the interior surface correspond to the magnetic field density contours of the high-gradient magnetic field. Generally, the magnetically labelled particles are immobilised at sections or zones along the interior surface of the sample vessel that correspond or correlate to the high density regions of the magnetic field.

Due to the superior high-gradient magnetic field, the magnetising portion (3) is also able to isolate nanommeter sized magnetically labelled particles, preferably in the range of 50 to 500 nm. The magnetising portion (3) is also able to separate and immobilise magnetically labelled particles in less than 5 minutes, preferably within 0.5 to 2 minutes.

First Embodiment of the Magnetising Portion

FIG. 3 depicts an embodiment of the magnetising portion (3) in its simplest form. The magnetising portion (3) comprises a single magnetic assembly with two magnets (M1, M2). The magnets are stacked substantially vertically, one above the other. The magnets are stacked such that the axes (Y-Y') of each magnet extend substantially horizontally. The two magnets (M1, M2) are arranged such that the north and south poles of adjacent magnets are arrange alternately. The magnets (M1, M2) are bar shaped magnets with flat pole end faces (FEF). An aluminium spacing plate (SP) is arranged between the adjacent magnets; between magnets M1 and M2. The magnetic assembly has cuboid-like shape with two side walls (100, 101), two end faces (102,103), an upper surface (104) and a lower surface (105). End face 102 has a first alternating multipole surface with a NS configuration. End face 103 has a second alternating multipole surface with a SN configuration. The magnetic field of the second alternating multipole surface is restricted by a pole piece (110) mounted to extend along the second alternating multipole surface.

The magnetic field produced by the magnetic assembly is a high-gradient magnetic field with at least a substantially constant performance. When the single magnetic assembly is arranged such that the first alternating multipole surface is proximate a sample vessel, the sample vessel is subject to a high-gradient "fringe" magnetic field. Due to the configuration of the magnets the fringe magnetic field is substantially perpendicular to the longitudinal axis of the sample vessel.

Second Embodiment of the Magnetising Portion

Figure 4A:
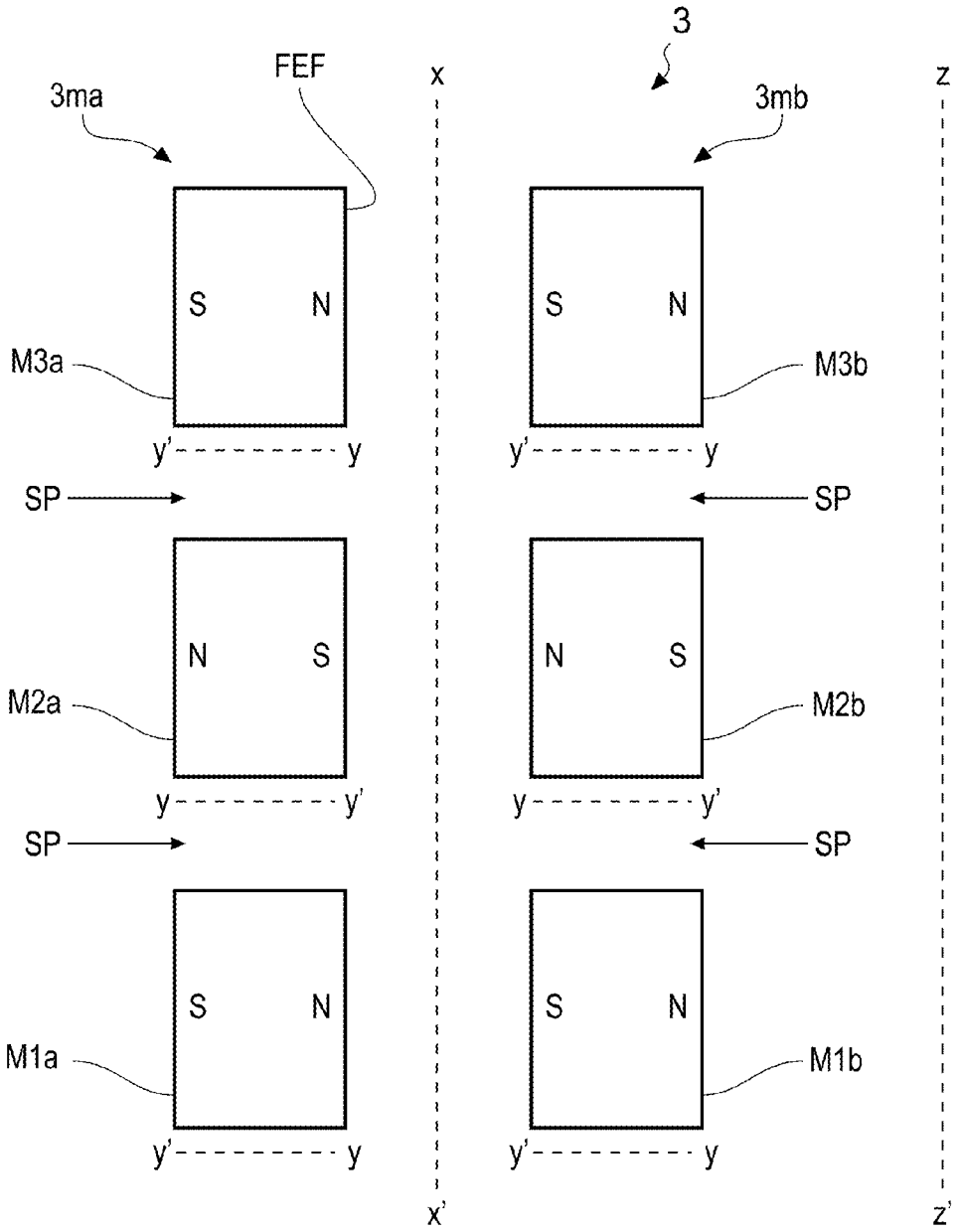
FIG. 4*a* is a side-view of a second embodiment of a magnetising portion according to the disclosure.
Figure 4B:
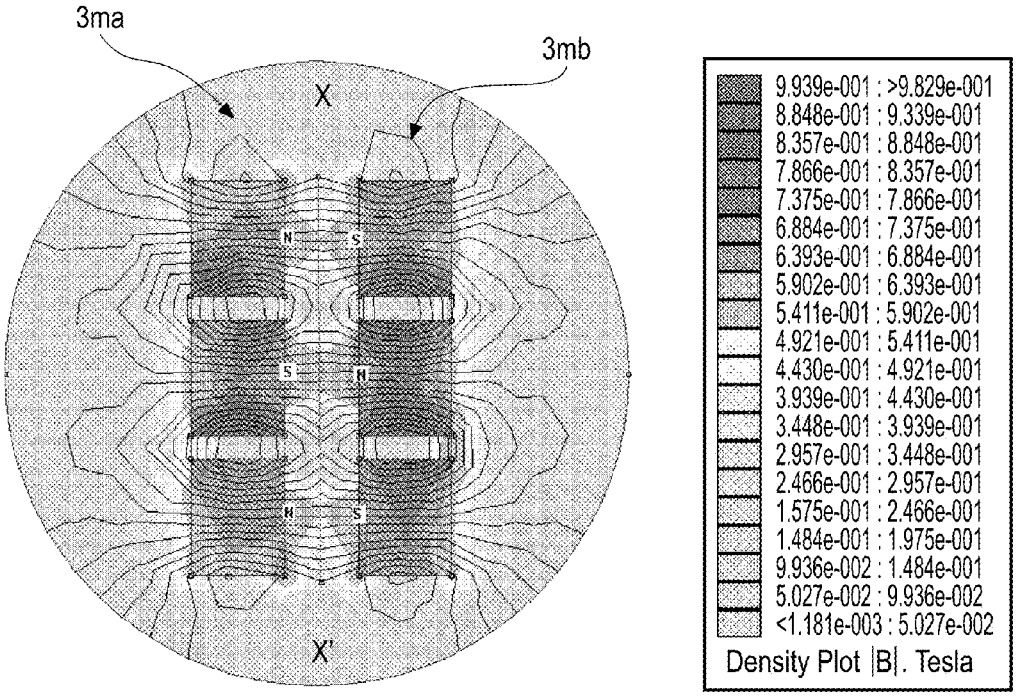
FIG. 4*b* depicts the magnetic field generated by the magnetising portion of FIG. 4*a;*
Figure 4C:
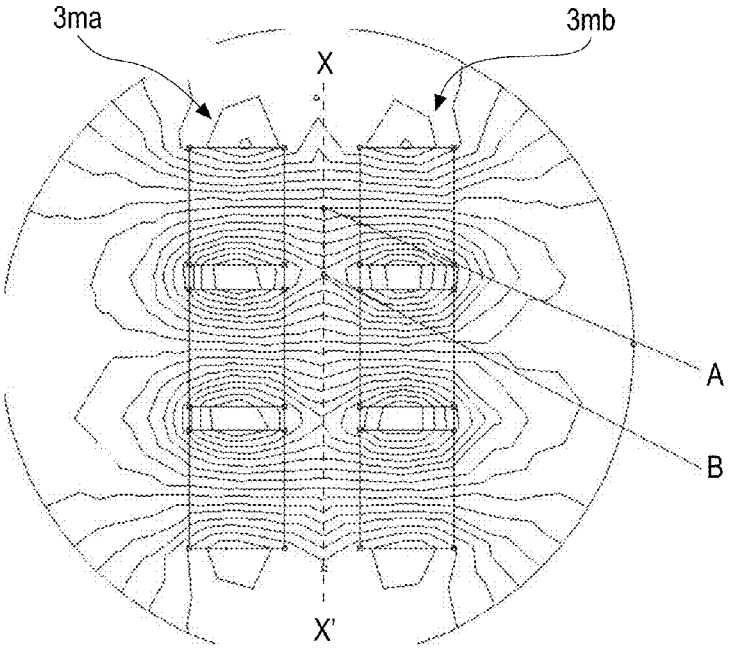
FIG. 4*c* depicts the regions of high magnetic field density and low magnetic field density generated by the magnetising portion of FIG. 4*a;*
Figure 5B:
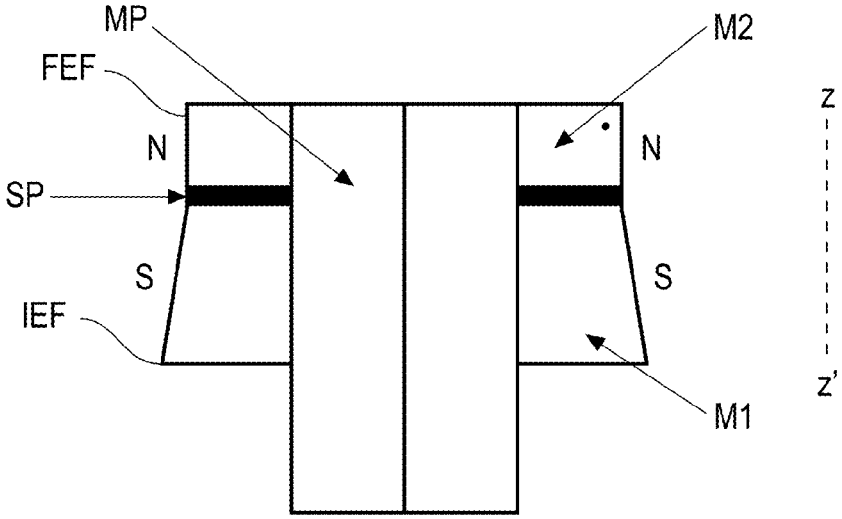

FIG. 4*a* depicts a second embodiment of the magnetising portion (3) comprising two magnetic assemblies (3*ma*, 3*mb*). The magnetic assemblies are mounted in parallel relation. A central region, void or space is formed between the magnetic assemblies. The void is shaped such that it is suitable for receiving a sample vessel. The centre line, or central longitudinal axis of the magnetising portion (3) is marked X-X'. The central longitudinal axis is the furthest point within the central region from a magnetic assembly and therefore the most difficult area to influence. The first magnetic assembly (3*ma*) comprises three magnets (M1*a*-M3*a*). The magnets of the first magnetic assembly (3*ma*) are stacked vertically such that the alternating multipole surface facing the second magnetic assembly (3*mb*) has a NSN configuration. The second magnetic assembly (3*mb*) also comprises three magnets (M1*b*-M3*b*). The magnets of the second magnetic assembly (3*mb*) are stacked vertically such that the alternating multipole surface facing the first magnetic assembly (3*ma*) has a SNS configuration. Hence, the corresponding magnets in the first and second magnetic assemblies (M1*a* & M1*b*, M2*a* & M2*b*, M3*a* & M3*b*) are diametrically opposed. The magnets (M1*a*-M3*b*) are bar shaped magnets with flat pole end faces (FEF). Adjacent magnets M1*a* & M2*a*, M2*a* & M3*a*, M1*b* &M2*b*, M2*b* & M3*b* are separated by a respective air gap (SP).

In use, the magnetic assemblies of this particular embodiment will be mounted in parallel relation on opposing sides and proximate a sample vessel. The magnetic field produced by the magnetic assemblies has a high-gradient and at least a substantially constant performance. The flux lines of FIG. 4*b* indicate that a sample vessel located between the two magnetic assemblies will be subject to a high-gradient "direct" magnetic field. The high-gradient magnetic field is considered to be "direct" because at least a substantial part of the magnetic field extends between the opposing magnets of the first and second magnetic assemblies. Due to the configuration of the magnets, the direct magnetic field is substantially perpendicular to the longitudinal axis of the sample vessel. The non-magnetic spacing means (SP) provided between the adjacent magnets of the first and second magnet assemblies reduce or restrict the flow of magnetic flux (the fringe field) between the adjacent magnets. Thus, the magnetic flux is encouraged to travel between the diametrically opposed magnets of the first and second magnetic assemblies. As a direct consequence, the magnetic field density in central region A between the opposing magnets is high and the magnetic field density in central region B between the non-magnetic spacing means is low—see FIG. 4*c*.

Figure 4D:
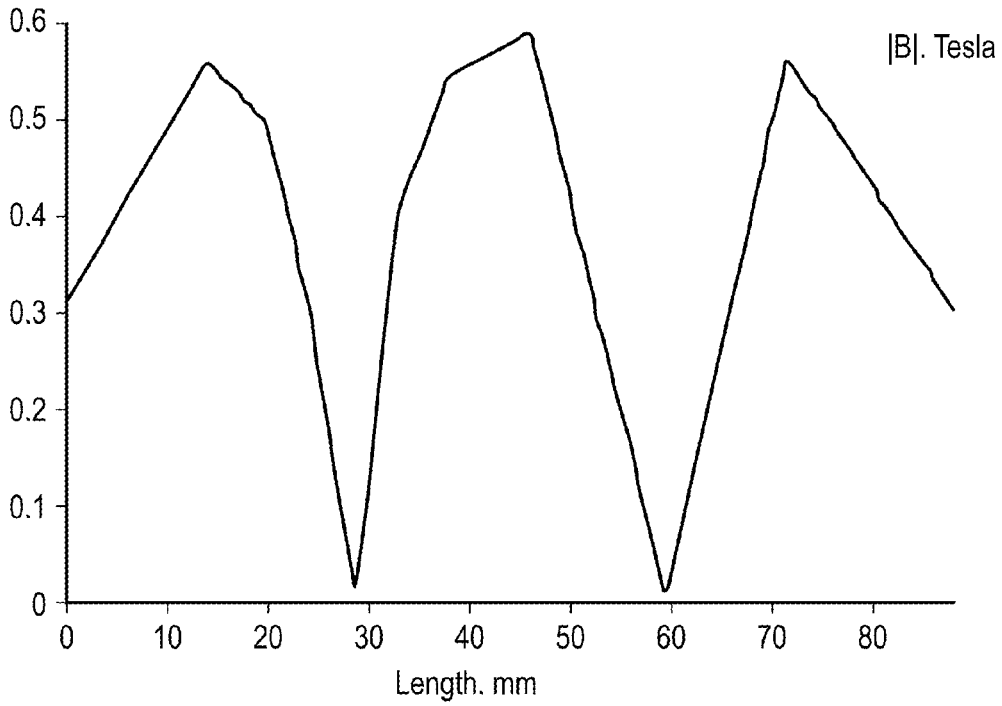
FIG. 4*d* is a graph showing how the magnetic field strength varies along the central longitudinal axis of the magnetising portion of FIG. 4*a;*

FIG. 4*d* is a graph showing how the magnetic field strength varies along the central longitudinal axis (X-X') of the magnetising portion (3). FIG. 4*d* indicates that each of the high density regions has a substantially identical maximum value of magnetic field strength and each of the low density regions has a substantially identical minimum value of magnetic field strength. In this particular embodiment, the peak strength in the high density regions is approximately 0.55 B and the minimum strength in the low density regions is almost 0.0 B (zero). Since the variation of the magnetic field is substantially consistent along the central longitudinal axis (X-X') of the magnetising portion (3) the performance of the magnetising portion is substantially constant.

Figure 4E:
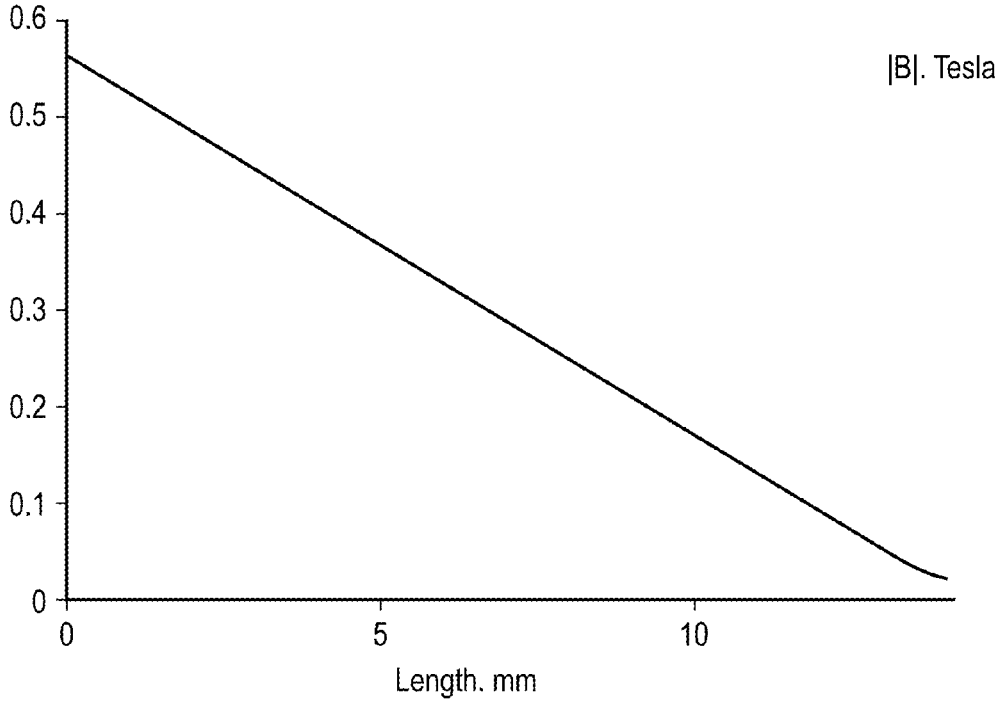
FIG. 4*e* is a graph showing gradient of the magnetic field between a high density region and low density region of the magnetising portion of FIG. 4*a;*

Due to the significant variation in field strength between the high density regions A and low density regions B, the magnetising portion produces a high-gradient magnetic field. FIG. 4*e* depicts the gradient of the magnetic field by showing how the magnetic field strength varies between the high density regions A and low density regions B.

Third Embodiment of the Magnetising Portion

FIGS. 5*a* and 5*b* depict a third embodiment of the magnetising portion (3) comprising a plurality of magnetic assemblies (3*ma*-3*mf*) arranged in a substantially radial or circumferential configuration. The magnetic assemblies (3*ma*-3*mf*) are arranged in a substantially circumferential array about a magnetic assembly mounting portion (MP). Each magnetic assembly comprises two magnets, a first magnet (M1) and a second magnet (M2). The magnets (M1, M2) are stacked vertically in an alternating multipole configuration. An aluminium spacing plate (SP) is arranged between the adjacent magnets. Each magnetic assembly has a first alternating multipole surface with a SN configuration and a second alternating multipole surface with a NS configuration. However, the magnetic field of the second alternating multipole surface is restricted by the magnetic assembly mounting portion (MP). The magnetising portion is configured such that, in use, the first alternating multipole surface of each magnetic member may be arranged proximate a sample vessel. So as to further improve the effects of the high-gradient magnetic field, FIG. 5*b* shows how the pole face of the first magnet M1 is inclined (IEF) such that it follows the sloping contours of the sample vessel. (The pole face of the second magnet M2 is a substantially flat end pole face (FEF)) Although, this radial configuration may be used with any conventional sample vessel, the embodiment depicted in FIGS. 5*a* and 5*b* is particularly suitable for smaller sample vessels such as micro centrifuge tubes.

Fourth Embodiment of the Magnetising Portion

Figure 6A:
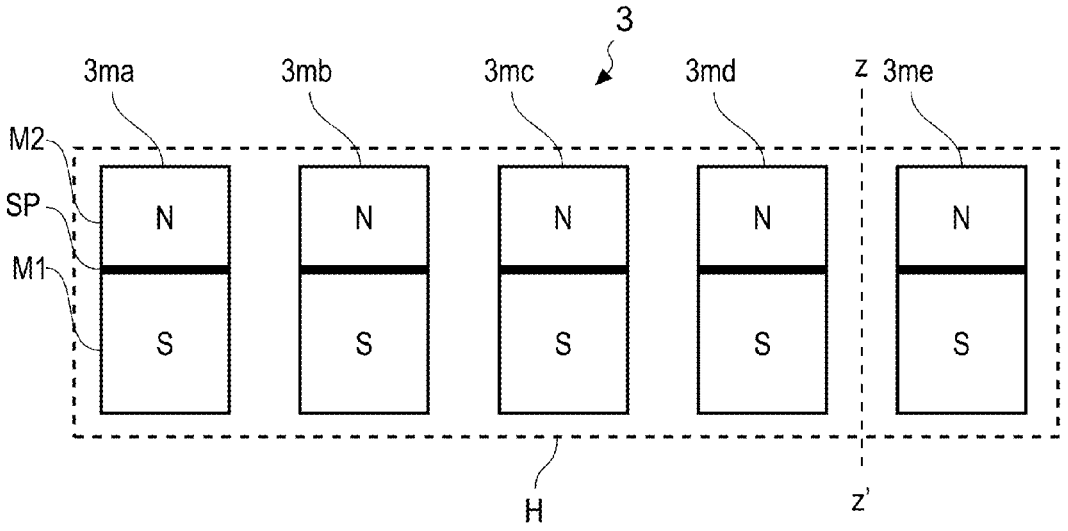
FIGS. 6*a* and 6*b* are a side view and a cross-sectional view respectively of a fourth embodiment of a magnetising portion according to the disclosure.
Figure 6B:
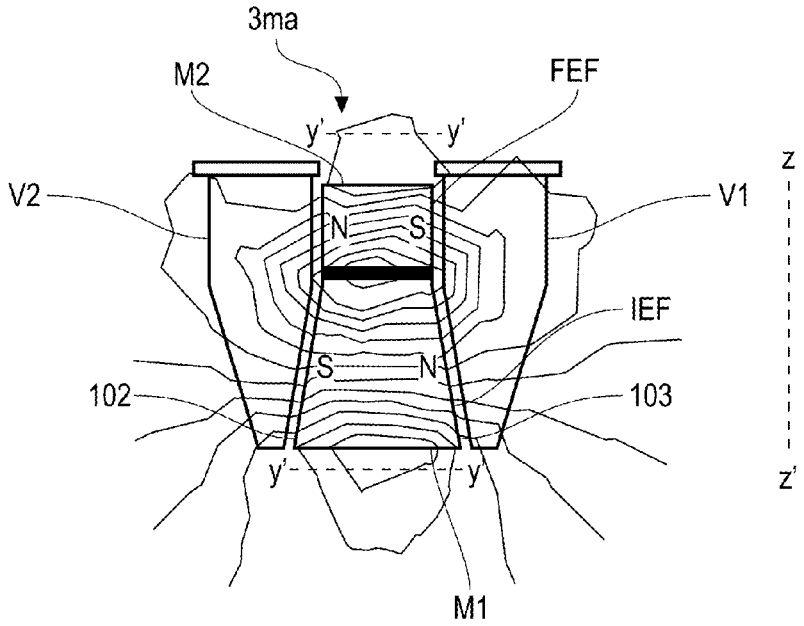

FIGS. 6*a* and 6*b* depict a fourth embodiment of the magnetising portion (3) comprising a plurality of magnetic assemblies (3*ma*-3*me*) arranged in a substantially linear array within a housing (H). FIG. 6*a* is a side-view of the magnetising portion showing the substantially linear array of magnetic assemblies. Each magnetic assembly comprises two magnets, a first magnet (M1) and a second magnet (M2). The magnets are stacked vertically in an alternating multipole configuration. An aluminium spacing plate (SP) is arranged between the adjacent magnets. Each magnetic assembly has a first alternating multipole surface and a second alternating multipole surface. The magnetic assemblies are configured such that, in use, the first alternating multipole surface may be arranged proximate a first sample vessel (V1) and the second alternating multipole surface may be arranged proximate a second sample vessel (V2). FIG. 6*b* is a cross-sectional view of magnetic member 3*ma* showing how the alternating multipole surfaces are arranged with respect to vessels. So as to further improve the effects of the high-gradient magnetic field, FIG. 6*b* shows how the pole faces of the first magnet M1 are inclined (IEF) such that they follows the sloping contour of the sample vessel. (The second magnet M2 has substantially flat pole end faces (FEF)). Although this configuration is suitable for use with any conventional sample vessel, this embodiment depicted in FIGS. 6*a* and 6*b* is particularly suitable for smaller sample vessels such as micro centrifuge tubes.

Magnetic Separation Devices Comprising the Magnetising Portion

Magnetic separation devices use high-gradient magnetic fields to attract and separate magnetically labelled particles from a non-magnetic fluid. The magnetising portion of the present disclosure is suitable for use in a magnetic separation device. When used as part of a magnetic separation device, the magnetising portion of the present disclosure provides a superior high-gradient magnetic field that is able to isolate nanommeter sized particles efficiently and accurately.

Embodiments of a Magnetic Separation Device Comprising a Plurality of the Magnetising Portions FIGS. 7*a* to 19*c* depict embodiments of a first type of magnetic separation device comprising a plurality of the magnetising portions. In these particular embodiments, the first type of magnetic separation device comprise a body portion (1) having an array of sample vessel retaining portions (2) and a plurality of magnetising portions (3) according to the present disclosure.

Each sample vessel retaining portion (2) is configured to receive and retain a sample vessel (4) such that one or more sample vessels may be mounted in the rack.

The plurality of magnetising portions (3) is arranged within the body portion (1) in order to provide a high-gradient magnetic field. The magnetising portions (3) are configured within the magnetic separation device such that a magnetising portion (3) is arranged in association with a sample vessel retaining portion. Each magnetising portion (3) comprises at least two magnetic assemblies (3*m*). The magnetic assemblies (3*m*) are circumferentially spaced apart about each sample vessel retaining portion (2). More specifically, the magnetising portions (3) are configured such that at least two magnetic assemblies (first magnetic assembly 3*ma*, second magnetic assembly 3*mb*) are associated with each sample vessel (4). The first and second magnetic assemblies (3*ma*, 3*mb*) are mounted in parallel relation on opposite sides and proximate each sample vessel retaining portion (2). Thus, a sample vessel (4) retained within the sample vessel retaining portion (2) is located between at least the first and second magnetic assemblies (3*ma*, 3*mb*) and is therefore subject to a high-energy magnetic field.

Figure 10:
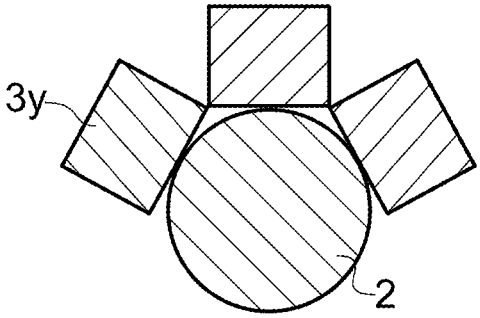
FIG. 10 is a plan-view showing a configuration of a plurality of magnets with respect to a sample vessel.
Figure 11:
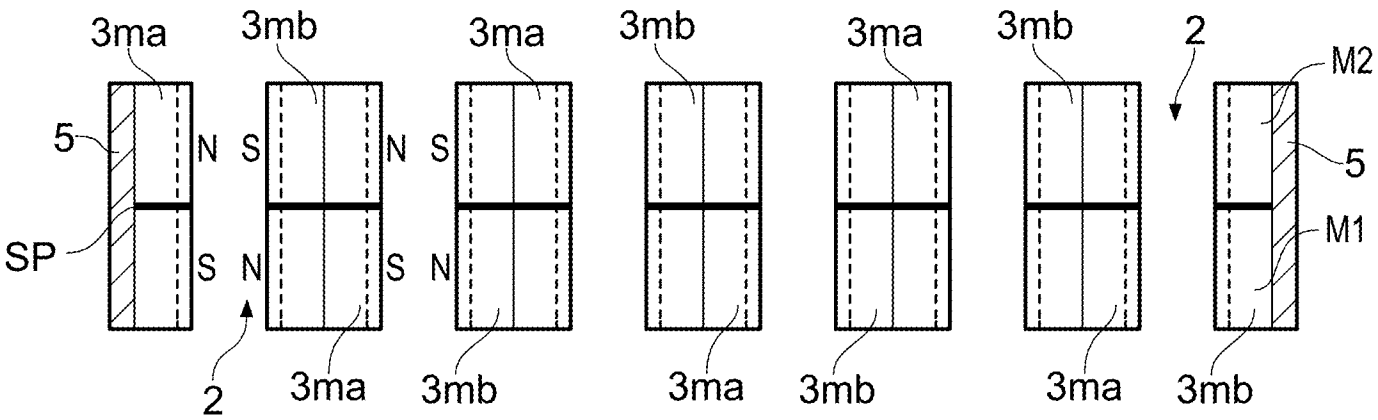
FIG. 11 is a side-view showing how the magnetising portions may be arranged with respect to the sample vessel retaining portions.
Figure 12A:
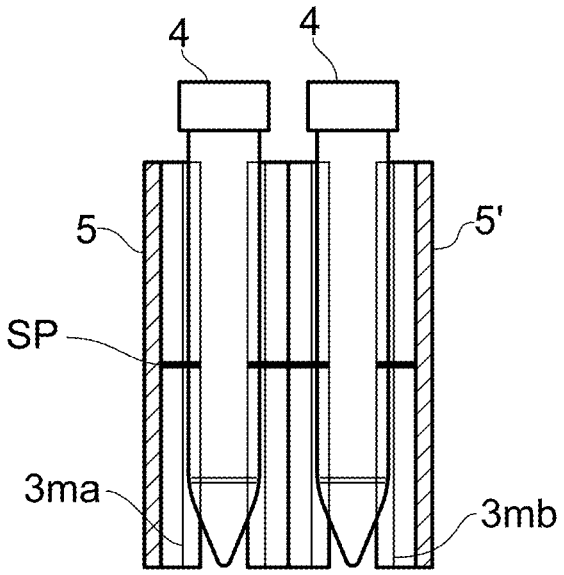
FIGS. 12*a* and 12*b* are side-views showing how the magnetising portions may be arranged with respect to the sample vessels.
Figure 12B:
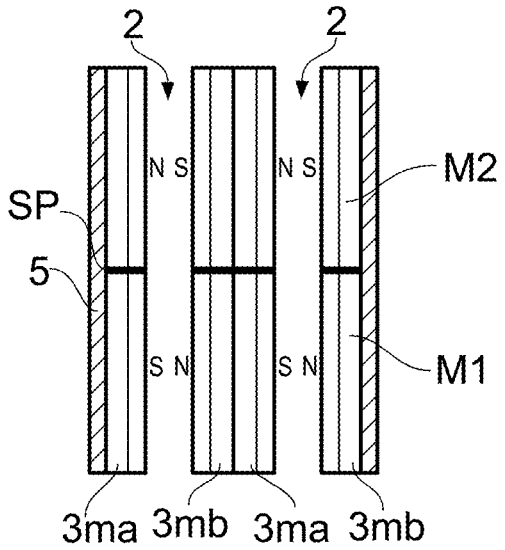
Figure 13A:
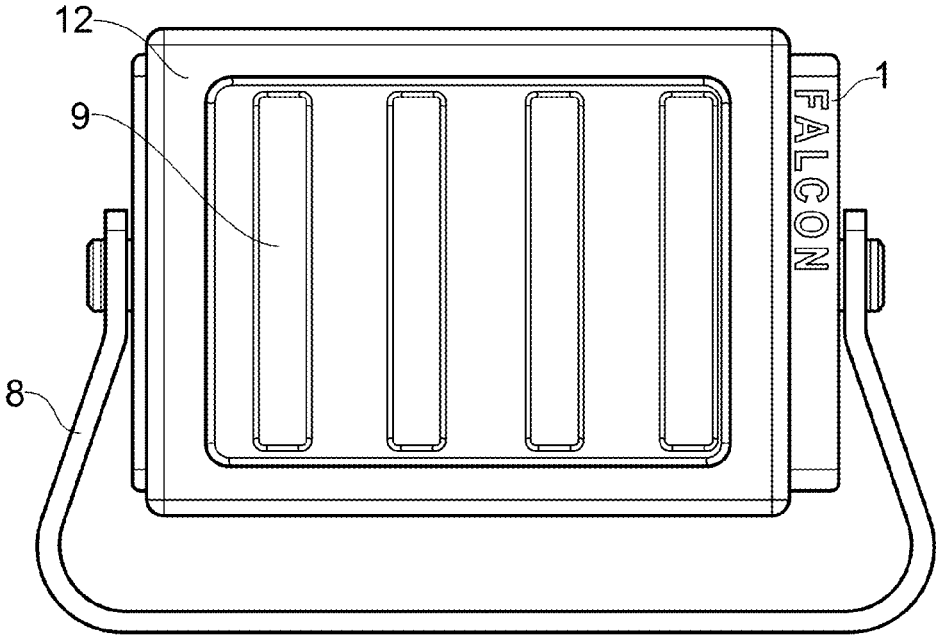
FIGS. 13*a*, 13*b* and 13*c* are a side-view, plan-view and perspective view respectively of a third embodiment of the first type of magnetic separation device according to the disclosure.
Figure 13B:
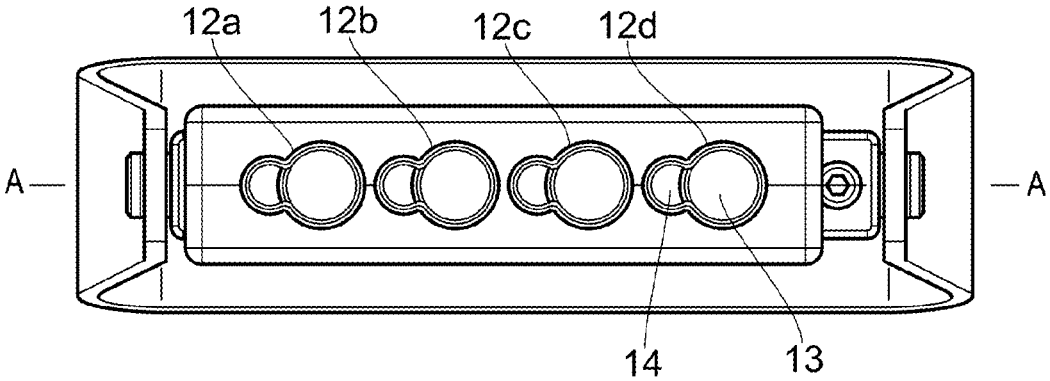
Figure 13C:
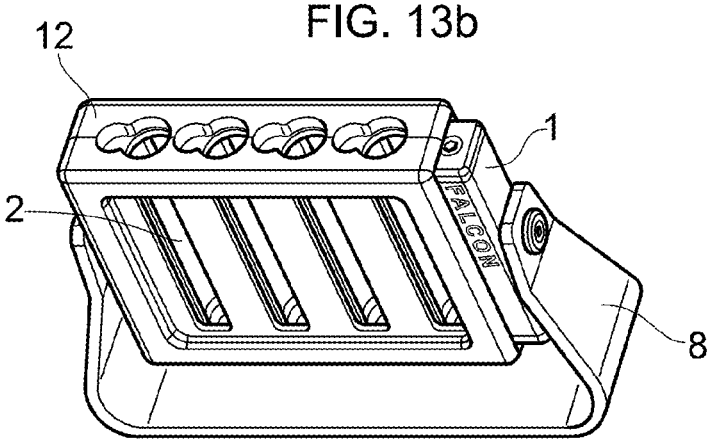
Figure 14:
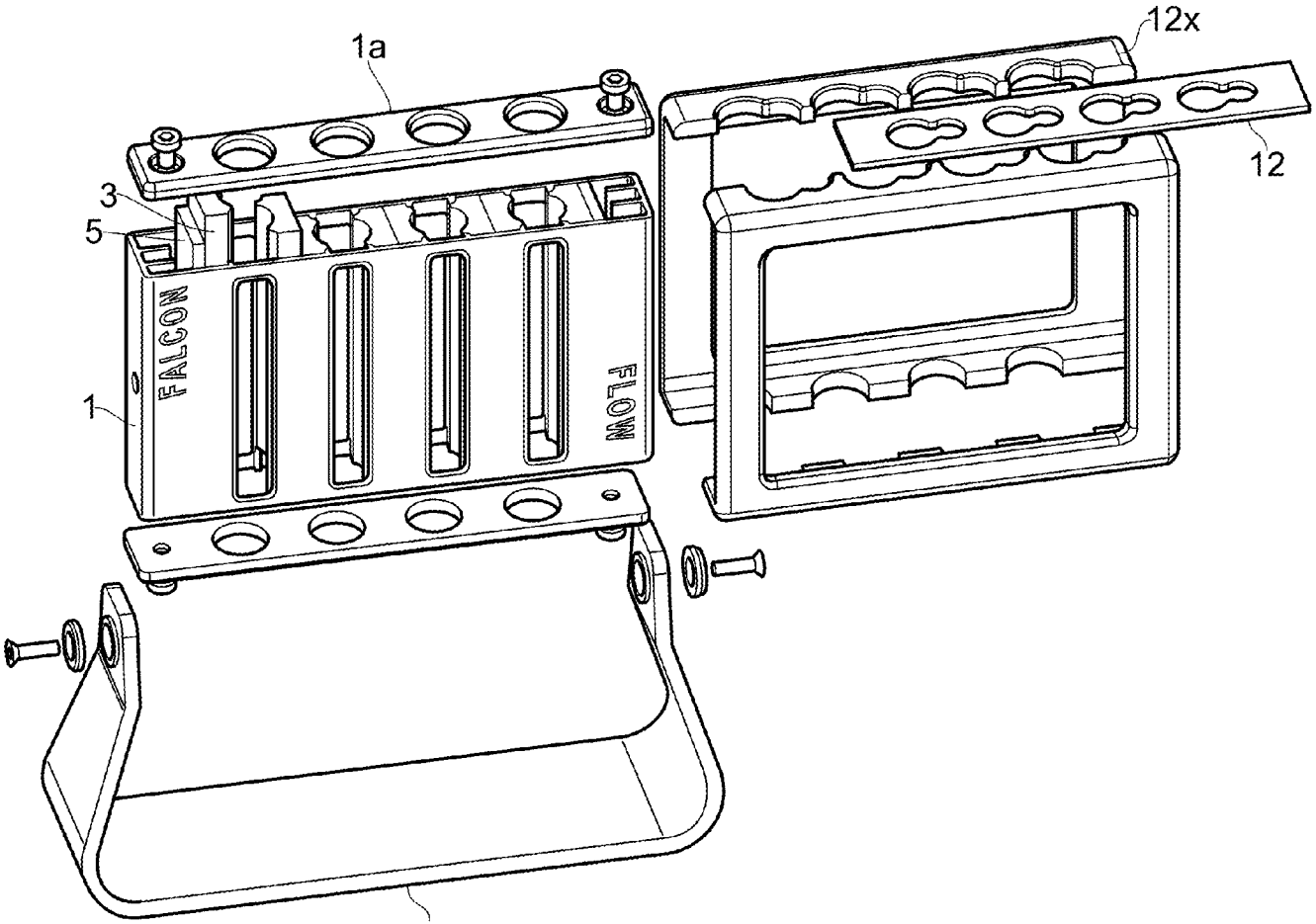
FIG. 14 is a schematic exploded perspective view of the third embodiment of the first type of magnetic separation device according to the disclosure.

FIGS. 7*b*, 10, 11, 12*a*, 12*b* and 14 show how a plurality of magnetising portions (3) may be mounted with respect to an array of sample vessel retaining portions (2). The magnetising portions (3) are configured such that a first magnetic assembly (3*ma*) and a second magnetic assembly (3*mb*) are arranged in close proximity to each sample vessel retaining portion. The first and second magnetic assembly (3*ma*, 3*mb*) are arranged in parallel on either side of each sample vessel retaining portion (2). In FIGS. 11 and 12*b*, the magnetic assemblies (3*ma*, 3*mb*) each comprise two magnets (M1, M2). The magnets in each magnetic assembly are stacked vertically with an aluminium spacing plate (SP) arranged therebetween. The magnets of the first magnetic assembly are arranged such that the alternating multipole surface proximate the sample vessel retaining portion has a SN configuration. The magnets of the second magnetic assembly are arranged such that the alternating multipole surface proximate the sample vessel retaining portion has a NS configuration. Hence, the alternating multipole configuration of the first magnetic assembly (3*ma*) is opposite to the alternating multipole configuration of the second assembly (3*mb*). Pole pieces (5) are mounted adjacent the end most magnetising portions in order to restrict the magnetic field.

The at least one magnetic assembly of the magnetising portions (3) is shaped and arranged such that a substantial portion of a sample vessel (4) is encompassed by magnetic material whilst a gap is provided that is suitable for viewing purposes. This may be achieved by shaping the at least one magnet of the magnetising portions (3) such that it has a face which conforms at least approximately to the shape of a sample vessel (4). Alternatively, the magnetising portion (3) may comprise a plurality of conventional bar magnets (3*y*), having substantially flat faces, that are arranged to encircle or envelop a certain portion of the width of the sample vessel retaining portion (2) as shown in FIG. 10.

When a sample vessel (4) is received and retained by a sample vessel retaining portion (2) it is arranged between the first and second magnetic assemblies (3*ma*, 3*mb*) such that it is subject to a high-gradient magnetic field. Consequently, the magnetically labelled particles suspended within a sample are attracted by the magnetic assemblies (3*ma*, 3*mb*) and immobilised at selected regions along the interior surface of the sample vessel (4). These selected regions are sections or zones of the interior surface of the sample vessel (4) adjacent the magnetic assemblies; i.e. regions of the interior surface closest to the at least one magnet mounted within the first and second magnetic assemblies (3*ma*, 3*mb*).

By arranging a pair of magnetic assemblies (3*ma*, 3*mb*) in parallel relation, on opposing sides of and proximate each sample vessel retaining portion (2) a direct high-gradient magnetic field is generated.

Figure 9:
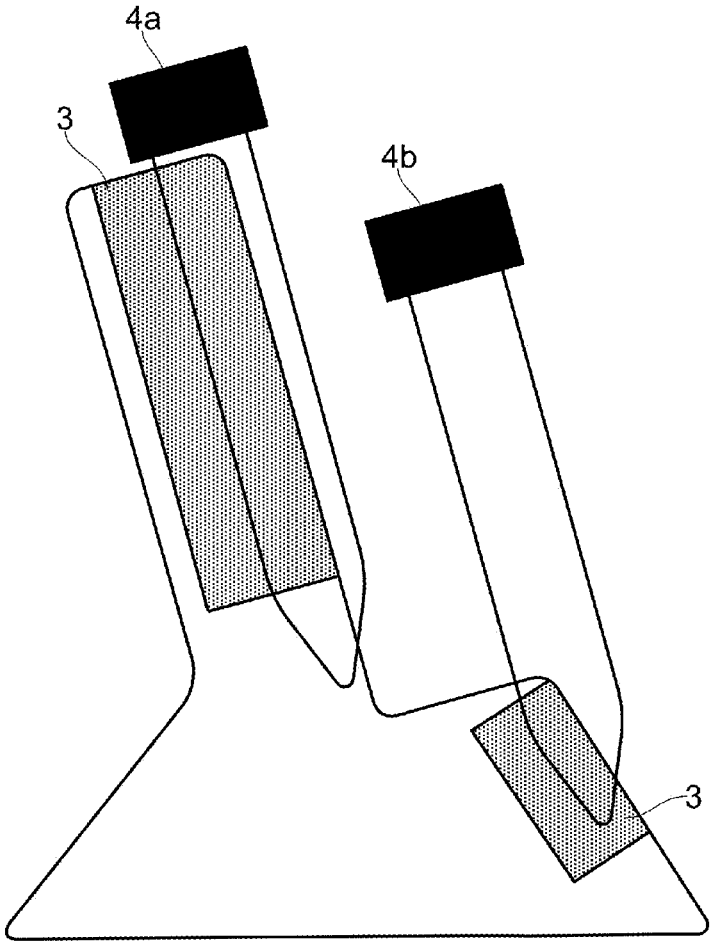
FIG. 9 illustrates how the magnetising portions may be configured with respect to the main volume of a sample vessel and the tip of a sample vessel.

The at least one magnetic assembly (3*m*) of the magnetising portions (3) may be shaped and arranged such that at least a main volume of each associated sample vessel (4) is subject to a high-gradient magnetic field. Alternatively, the at least one magnetic assembly (3*m*) of the magnetising portions (3) may be shaped and arranged such that only the tip of each associated sample vessel (4) is subject to a high-gradient magnetic field. FIG. 9 is provided to illustrate these optional features. The figure depicts an arrangement where only the main body of a first sample vessel (4*a*) is arranged between a parallel pair of magnetic assemblies (3*ma*, 3*mb*) and only the tip of a second sample vessel (4*b*) is arranged between a parallel pair of magnetising portions (3).

The body portion (1) of the magnetic separation device preferably comprises an upper surface (1*a*), lower surface (1*b*), front wall (1*c*), back wall (1*d*) and two side walls (1*e*, 1*f*). Clearly, the body portion must be formed from a non-magnetic material. The material is preferably easy to clean and resistant to disinfectant and/or other aggressive chemicals.

As mentioned above, a sample vessel retaining portion (2) is suitable for receiving and retaining a sample vessel (4). The sample vessel retaining portion (2) may be sized and shaped to receive and retain sample vessels of any conventional size and in particular sample vessels having a diameter up to 30 mm and volumes typically ranging from about 5 to 50 ml. Alternatively, the sample vessel portion (2) may be configured to retain much smaller vessels, for example 0.5 to 2.0 ml micro-centrifuge tubes available from Eppendorf A. G., Hamburg, Germany.

Each sample vessel retaining portion (2) is in some preferred embodiments defined by the minimum number of integers required to provide stable location of the sample vessel in its position of use. Moreover, the sample vessel retaining portions (2) are typically at least partially defined by the circumferentially mounted magnetic assemblies (3*m*) of the magnetising portions (3).

As with any conventional device, the first type of magnetic separation device may comprise a one dimensional array of sample vessel retaining portions (2) or a two-dimensional array of sample vessel retaining portions (2). For example, the magnetic separation device may comprise a single row (one dimensional linear array) of sample vessel retaining portions (2) as depicted in the Figures. Alternatively, the magnetic separation device may comprise two rows of sample vessel retaining portions (2) or even a plurality of sample vessel retaining portions (2) arranged in rows and columns (two dimensional array).

Each sample vessel retaining portion (2) comprises an aperture (6) formed in the upper surface (1*a*) of the body portion (1) and a passage (7) that extends at least substantially through the body portion (1) from the aperture (6) in the upper surface (1*a*). The aperture (6) and passage (7) are sized and shaped such that they are suitable for receiving sample vessels (4) of a predetermined width and volume/length. It is noted that the passage (7) need not be completely defined by integers such as the magnetising portions (3) and walls of the body portion. Gaps or spaces may be provided between such integers, provided only that the sample vessel can be safely and stably retained in its position of use.

The aperture (6) formed in the upper surface (1*a*) of the sample vessel retaining portion (4) may be configured such that a rim of a sample vessel (4) of a predetermined width abuts the peripheral edge of the aperture (6) such that the sample vessel (6) is mounted or retained at the upper surface (1*a*). Depending on the volume/length of the sample vessel and the depth of the passage, a sample vessel (4) may be further or alternatively supported by an end face of the passage (7). The sample vessel (4) may be further or alternatively supported within the passage (7) using a supporting member (10) which is described in more detail below.

Figure 7A:
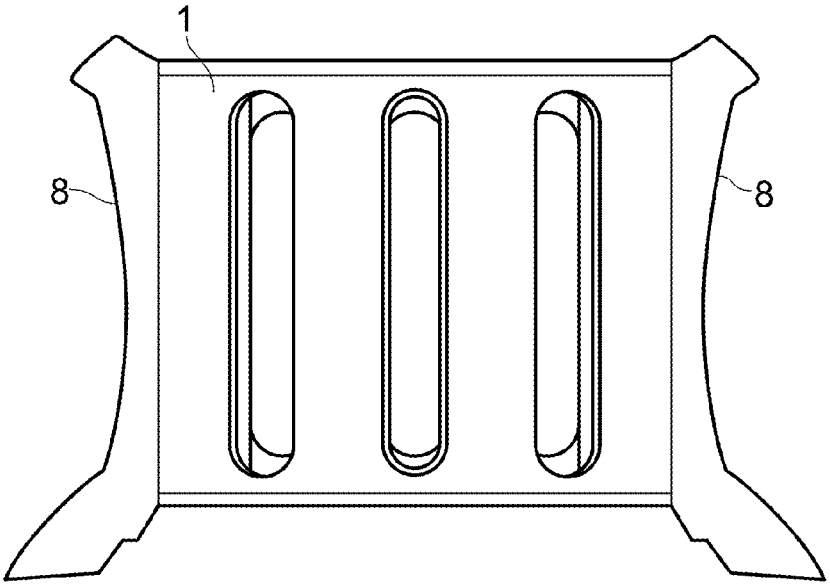
FIGS. 7*a* and 7*b* are a side-view and a schematic exploded perspective view respectively of an embodiment of the first type of magnetic separation device according to the disclosure.
Figure 7B:
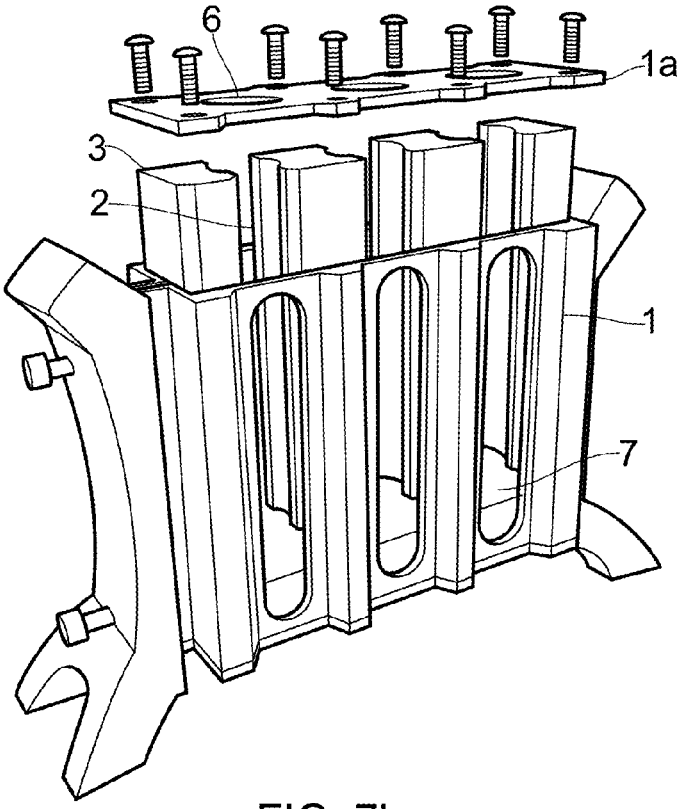

FIGS. 7*a* and 7*b* depict an embodiment of the first type of magnetic separation device comprising three sample vessel retaining portions (4). Each sample vessel retaining portion comprises an aperture (6) formed in the upper surface (1*a*) of the body portion (1) and a passage (7) that extends through the body portion (1) from the aperture (6) in the upper surface (1*a*) to the lower surface (1*b*) of the body portion (1). The size of the sample vessel that may be received and retained by the magnetic separation device depicted in FIGS. 7*a* and 7*b* is determined by the configuration of the apertures (6) and passages (7) of the sample vessel retaining portions (2). Thus, the magnetic separation device depicted in FIGS. 7*a* and 7*b* is suitable for receiving and retaining samples of a predetermined width and volume/length.

Each sample vessel retaining portion (2) may further comprise an aperture (6*b*) formed in the lower surface (1*b*) of the body portion (1) such that the passage extends through the body portion between the aperture (6*a*) formed on the upper surface (1*a*) and the aperture formed on the lower surface (1*b*). The aperture (6*b*) formed at the lower surface (1*b*) may be configured such that the tip of a sample vessel abuts the peripheral edge of the aperture such that the sample vessel (4) is mounted or retained at the lower surface (1*b*). The tip of the sample vessel (4) may also protrude through the aperture (6*b*) in the lower surface (1*b*). This type of arrangement is depicted in the FIG. 18*a*.

In the embodiments depicted in FIGS. 8*a-b*, 17, 18*a-c* and 19*a-c* each sample vessel retaining portion (4) comprises a first aperture (6*a*) formed in the upper surface (1*a*) of the body portion (1) of a first predetermined width, a second aperture (6*b*) formed in the lower surface (1*b*) of the body portion (1) of a second different predetermined width and a passage (7) that extends through the body portion (1) between the first aperture (6*a*) and the second aperture (6*b*). Thus, the magnetic separation device disclosed in FIGS. 8*a-b*, 17, 18*a-c* and 19*a-c* is suitable for receiving and retaining sample vessels of two different predetermined sizes by orientating the body portion (1) accordingly. The body portion (1) may be orientated by rotating/"flipping-over" the body portion (1) or by pivoting the body portion with respect to a foot portion (8). This may be achieved by pivotally coupling the foot portion (8) and the body portion (1) such that the body portion is rotatable with respect to the foot portion by at least approximately 180°. Hence, the rotatable body portion may be orientated such that sample vessels of a predetermined first width may be received and retained in the sample vessel retaining portion via apertures (6*a*) when the sample vessel retaining portion is oriented in a first orientation. Alternatively, the rotatable body portion may be orientated by rotating the body portion by approximately 180° with respect to the foot portion around axis A (see FIG. 8*b*) to a second orientation such that the sample vessels of a second predetermined width may be received and retained in the sample vessel retaining portion via the second apertures (6*b*)—as shown in FIGS. 8*a-b*, 17, 18*a-c* and 19*a-c*.

Each sample vessel retaining portion (2) preferably comprises at least one visible portion (9). The visible portion (9) may be an aperture and/or at least one transparent portion such that at least one portion of a sample vessel mounted in the sample vessel retaining portion (2) is visible. The visible portion of the sample vessel is preferably a portion extending at least substantially along the length of the sample vessel. The apertures or transparent portions are preferably formed in the front wall and/or rear wall of the body portion adjacent each passage of a sample vessel retaining portion (2).

Figure 8A:
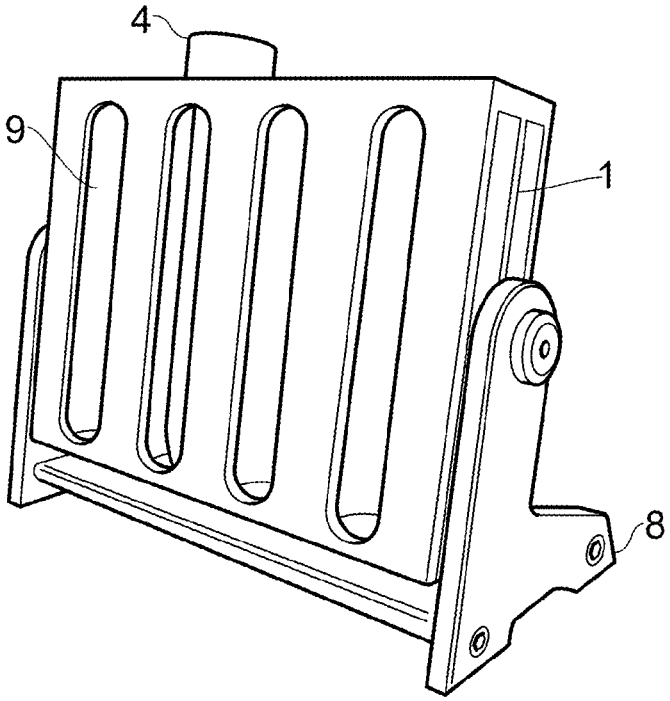
FIGS. 8*a* and 8*b* are a perspective view of the front of a second embodiment of the first type of magnetic separation device and a perspective view of the back of the second embodiment of the magnetic separation device respectively according to the disclosure.
Figure 8B:
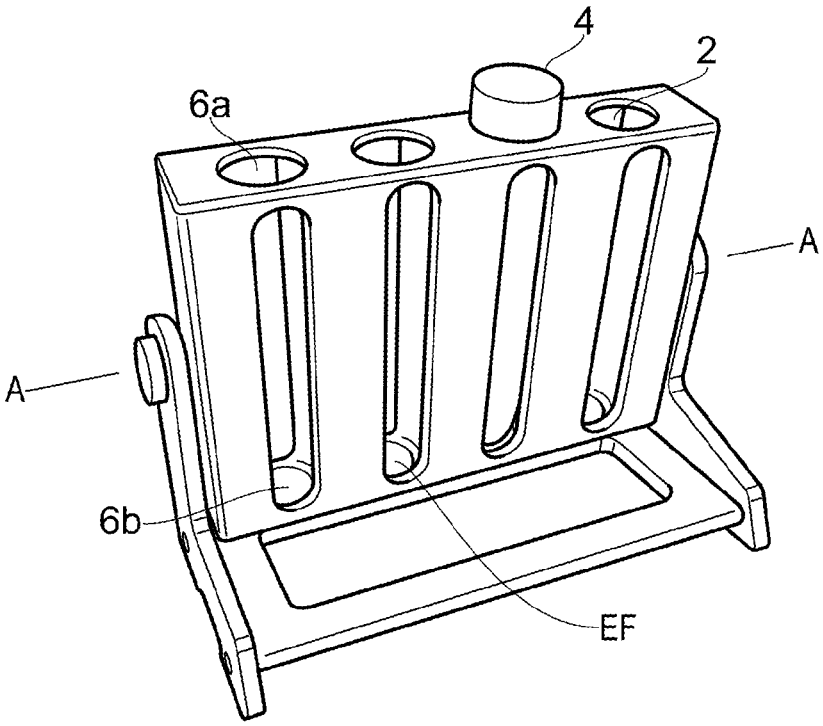

FIGS. 7*a-b*, 13*a-c*, 14, 15*a-b*, 16, 17, 18*a-c* and 19*a-c* depict embodiments of the first type of magnetic separation device where each sample vessel retaining portion (2) comprises two viewing apertures (9) extending longitudinally and substantially along the length of the passage (7) such that a substantial length of a sample vessel (4) mounted in the sample vessel retaining portion (2) can be seen through the viewing apertures (9) formed in the front wall (1*c*) and rear wall (1*d*) of the body portion (1). FIGS. 8*a* and 8*b* show an alternative arrangement where each sample vessel retaining portion (2) comprises two transparent regions (9) that extend longitudinally and substantially along the length of the passage (7) such that a substantial length of a sample vessel (4) mounted in a sample vessel retaining portion (2) is visible through the front wall (1*c*) and the rear wall (1*d*) of the body portion (1).

A skilled person will appreciate that the visible portions (9) are suitable for a magnetic separation device of the disclosure having a linear, one dimensional array of sample vessel retaining portions (2) or a magnetic separation rack of the disclosure having two rows of sample vessel retaining portions (2) whereby a first linear array of sample vessel retaining portions (2) is arranged to extend linearly along the front wall (1*c*) of the body portion (1) and a second linear array of sample vessel retaining portions (2) is arranged to extend linearly along the back wall (1*d*) of the body portion (2).

By providing at least one visible portion that extends at least substantially along the length of the sample vessel means the sample vessel may be viewed more easily. This is a significant advantage over prior art magnetic separation racks where inspection of the sample vessels is somewhat restricted and often necessitates the removal of the sample vessels from the device.

So as to further improve the visibility of the sample vessel (4), the magnetic separation device may be provided with lighting means to illuminate the sample vessel (4). Inspection of the sample vessel is improved when the lighting means particularly illuminate the at least one visible portion of the sample vessel as mentioned above. The lighting means may include one or more light emitting diodes (LED). The one or more LED may be mounted within the passage (7) of the sample vessel retaining portion (2) or within the body portion (1), without obstructing the entry or exit of the sample vessels (4). The one or more LED is preferably mounted in the end face of the passage (7) of each sample vessel retaining portion (2) that is, in the general area labelled EF.

The magnetic separation device may be further or alternatively provided with magnifying means to magnify at least a predetermined region of a sample vessel (2). The magnifying means is preferably arranged such that it magnifies at least a region of the at least one visible portion of the sample vessel as discussed above. Clearly, the magnifying means are provided to help further improve the visibility of the sample. The magnifying means may be a lens located in the one or more viewing apertures (9) configured to provide a visible portion of the sample vessel (4). The magnifying means may alternatively be a lens located adjacent or integrated as part of the one or more transparent portions (9) configured to provide a visible portion of the sample vessel (4).

The magnetic separation device further comprises at least one foot portion (8). The at least one foot portion is configured to enable the device to stand on a supporting surface such as a work station, shelf, table or the like. In its simplest form, the foot portion (8) may be a surface by which the body portion (1) may stand on a supporting surface. The foot portion (8) and body portion (1) may be provided as a unitary component. Alternatively, the foot portion (8) and body portion (1) may be separate elements.

The foot portion (8) may be pivotally coupled to the body portion (1) such that the body portion is operatively tiltable with respect to the foot portion. The foot portion is pivotally coupled to the body portion using pivotal coupling means. The pivotal coupling means may comprise hinges, axel pins or other conventional pivotal coupling means. The body portion maybe tiltable from a substantially vertical position by an angle of up to and including approximately 70°. The body portion (1) is preferably tiltable from a substantially vertical position to an angle ranging between approximately 30° to 60°. By tilting the body from a substantially vertical position a sample vessel may be viewed more easily through the at least one visible portion (9) of the sample vessel retaining portion.

Due to the at least one visible portion and pivotal coupling means a sample may be inspected more easily and simply without having to remove the sample vessel from the sample vessel retaining portion. The use and configuration of the at least one visible portion and the pivotal coupling means in the present disclosure helps to improve the inspection of the sample vessels and at least substantially overcomes the visibility problems associated with the prior art.

In FIGS. 7*a* and 7*b* the magnetic separating device comprises a foot portion (8) coupled to each side-wall of the body portion (1). FIGS. 8*a-b*, 17, 18*a-c* and 19*a-c* depict embodiments of the disclosure that comprise a foot portion (8) which is pivotally coupled to each side-wall of the body portion (1). This particular foot portion (8) not only enables the device to stand on a supporting surface, but it also enables the body portion (1) to be tilted as required. For example, the body portion (1) may be titled by pivoting the body portion (1) with respect to the foot portion (8) around axis A (see FIG. 8*b*) by an angle of approximately 45° to the vertical so that the user can easily inspect the sample vessels retained within the sample vessel retaining portions.

Figure 15B:
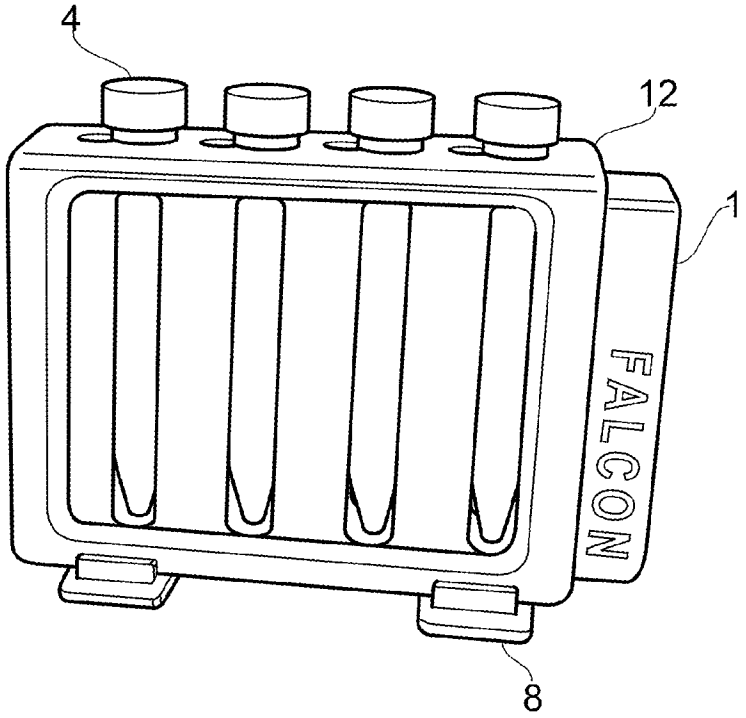
FIGS. 15*a* and 15*b* are perspective views of a fourth embodiment of the first type of magnetic separation device in a first and second position respectively according to the disclosure.
Figure 15A:
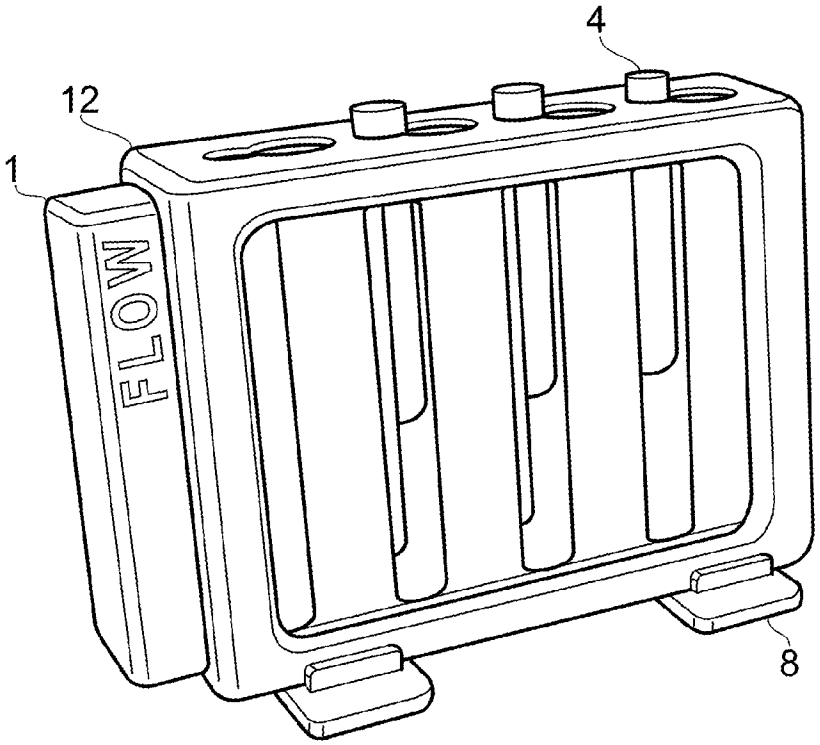
Figure 16:
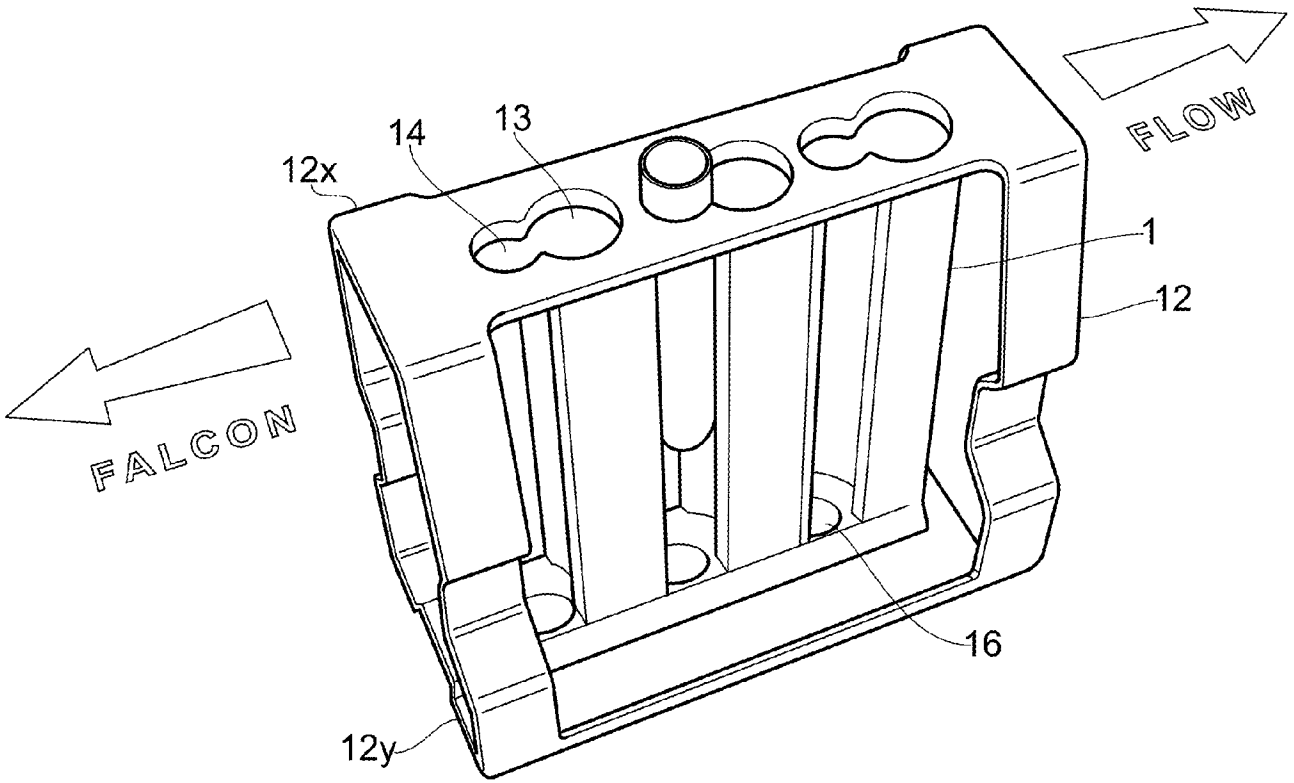
FIG. 16 is a perspective view showing the first and second positions of a fifth embodiment of the first type of magnetic separation device according to the disclosure.
Figure 17:
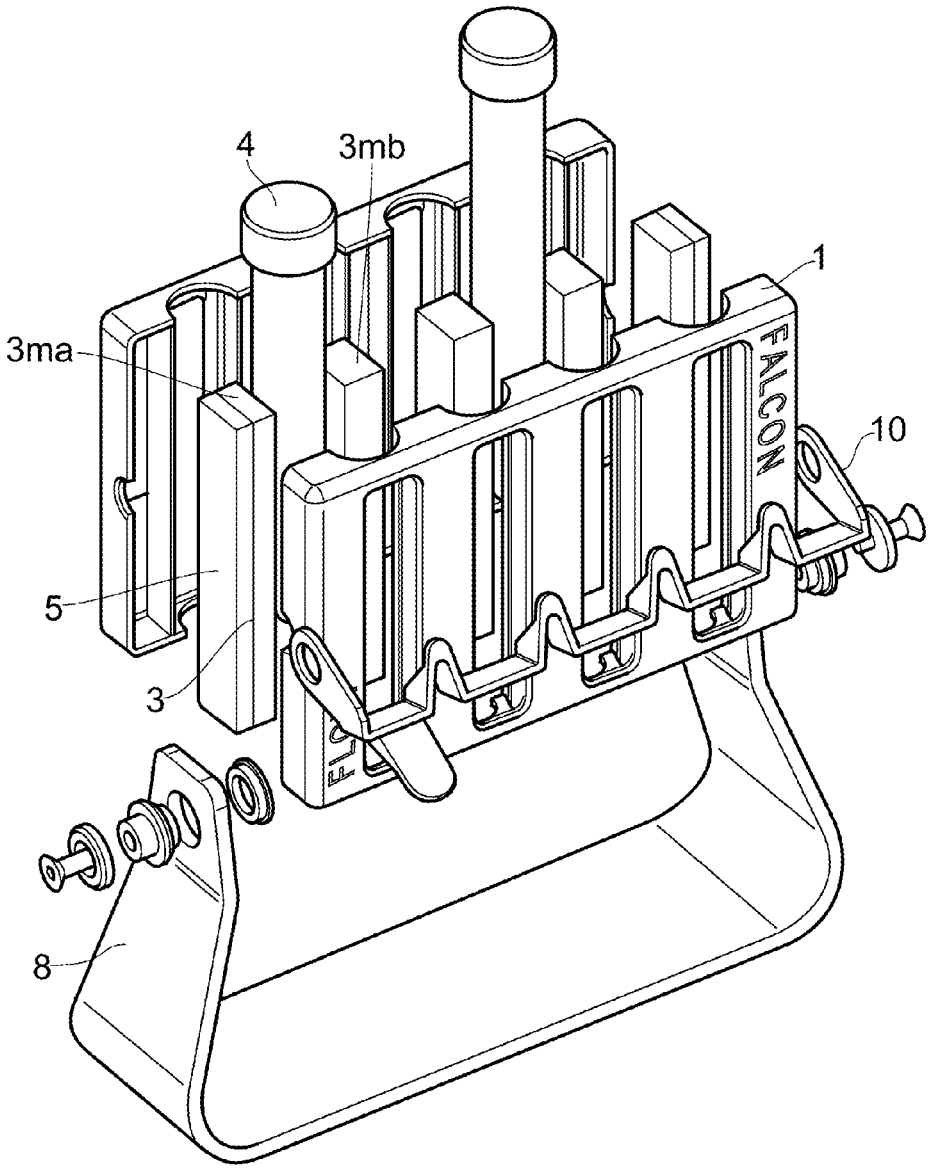
FIG. 17 is a schematic exploded perspective view of a sixth embodiment of the first type of magnetic separation device according to the disclosure.

FIGS. 15*a* and 15*b* depict an embodiment of magnetic separation device wherein the foot portion (8) comprises a pair of feet (8*a*) coupled to the lower surface of the frame (12). The feet (8*a*) may be optionally pivotally coupled to the lower surface of the frame (12) such that the frame (12) and the body portion (1) are operatively tiltable with respect to the feet (8*a*). FIG. 16 depicts an embodiment of the magnetic separation device that comprises a frame (12) (the aperture defining element—see later) which is mounted around the body portion (1) wherein a lower portion or lower surface (12*y*) of the frame acts as a foot portion when the rack is mounted such that sample vessels (4) may be received in each sample vessel retaining portion via apertures formed in the upper surface (12*x*) of the frame (12). The frame (12) may be optionally pivotally coupled to the body portion (1) such that the body portion is tiltable from a substantially vertical position within the frame. For example, the upper surface of the body portion (1) may be pivotally coupled to the frame (12).

The magnetic separation device may further or alternatively comprise a sample vessel supporting member (10). At least a portion of the sample vessel supporting member (10) is locatable within the sample vessel retaining portions (2) and is provided to support the tip of a sample vessel (4) within the passage (7) of the sample vessel retaining portion. The sample vessel supporting member (10) is movable between a first and a second position such that the relevant portion thereof can be located within the passage (7) when required. In the first position, the portion of the sample vessel supporting member (10) is located within the passage (7) of the sample vessel retaining portion (2). In the second position, the sample vessel supporting member (10) is spaced apart or located outside the passage (7). The relevant portion of the sample vessel supporting member (10) is locatable within the passage (7) of the sample vessel retaining portion (2) by inserting said portion through an aperture formed in the front and/or back wall of the body portion (1) adjacent each passage (7). This aperture may be the viewing which permits a user to view a portion of the sample vessel as discussed above. The sample vessel supporting member (10) may be moved between the first and second position by sliding or pivoting the sample supporting member (10) with respect to the body portion (1).

Figure 18A:
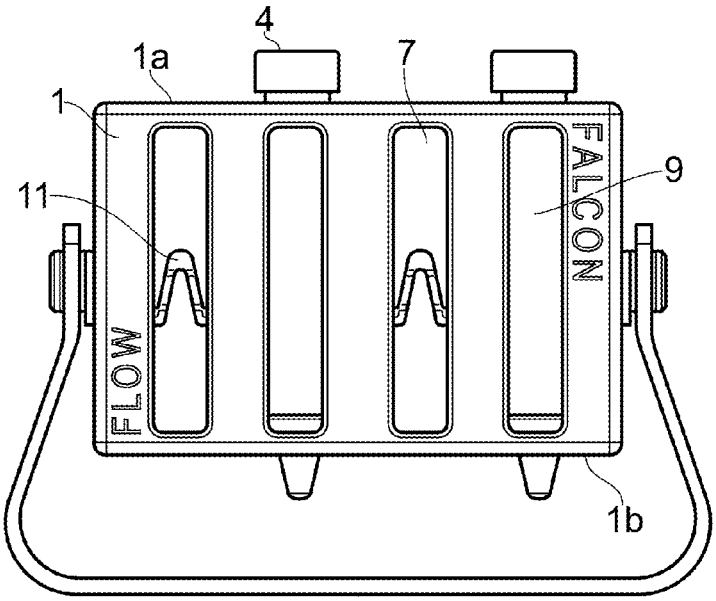
FIGS. 18*a*, 18*b* and 18*c* are a side-view, plan-view and perspective view of the sixth embodiment of the first type of magnetic separation device according to the disclosure when adapted to retain larger sample vessels.
Figure 18B:
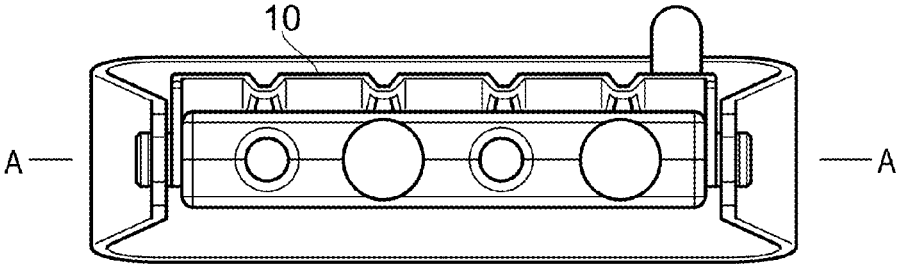
Figure 18C:
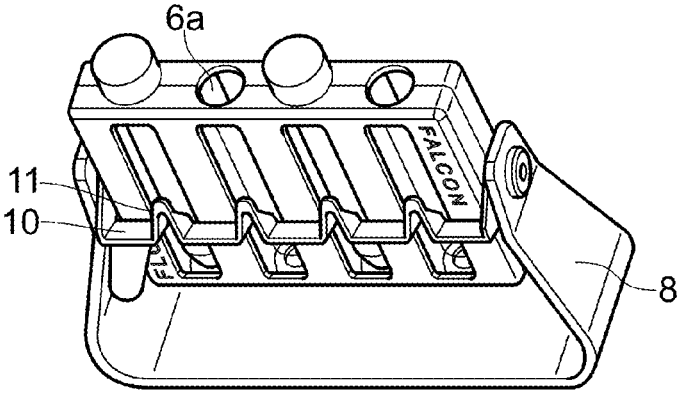

FIGS. 18*a-c* and 19*a-c* depict an embodiment of the magnetic separation device comprising a sample vessel supporting member (10). The sample vessel supporting member (10) is pivotally coupled to the body portion (1) such that it may be pivoted between a first position and a second position. In the first position, the sample vessel supporting member (10) is arranged externally to the body portion (1) and is not located within the passages (7) of the sample vessel retaining portions (2). In the second position, the sample vessel supporting member (10) is arranged such that a supporting portion (11) of the sample vessel supporting member (10) is located within the passage (7) of each sample vessel retaining portion (2). In FIGS. 18*a-c* the magnetic separation device is arranged to receive and retain samples vessels of a first predetermined size, e.g. "Falcon" test-tubes available under the Falcon brand from B. D. Falcon, New Jersey, U.S.A. The sample vessels of the first predetermined size are mounted within the sample vessel retaining portions (2) via the first apertures (6*a*) that are formed on the upper surface (1*b*) of the body portion (1). The sample vessels of the first predetermined size are configured such that the main volume of the sample vessel is arranged within the passage (7) of the sample vessel retaining portion (2) and the tip of the sample vessel protrudes through the aperture formed in the lower surface (1*b*) of the body portion (1). Hence, the sample vessel supporting member (10) is not required and is therefore mounted in the first position outside the body portion (1).

Figure 19A:
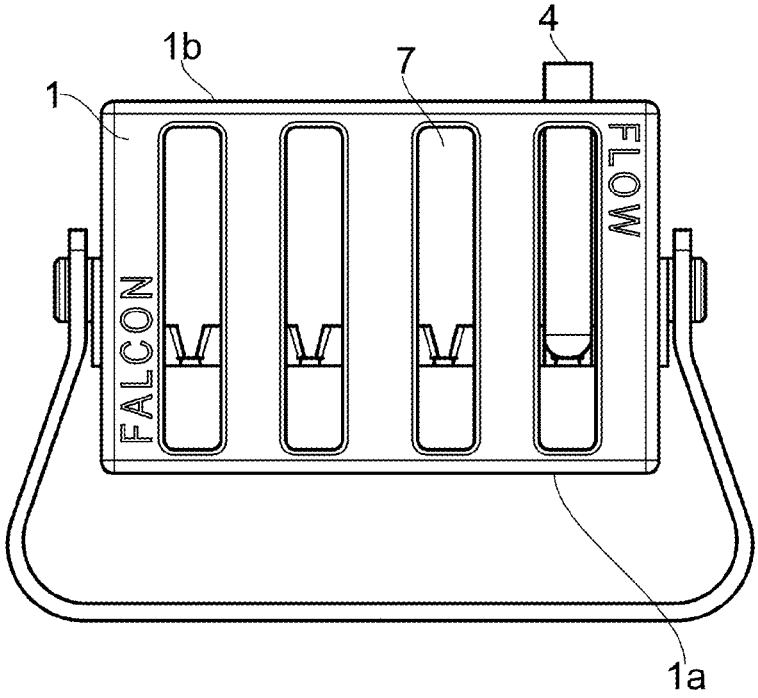
FIGS. 19*a*, 19*b* and 19*c* are a side-view, plan-view and perspective view of the sixth embodiment of the first type of magnetic separation device according to the disclosure when adapted to retain smaller sample vessels.
Figure 19B:
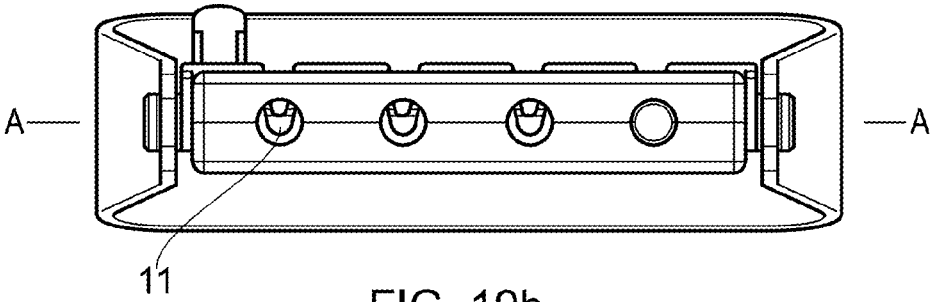
Figure 19C:
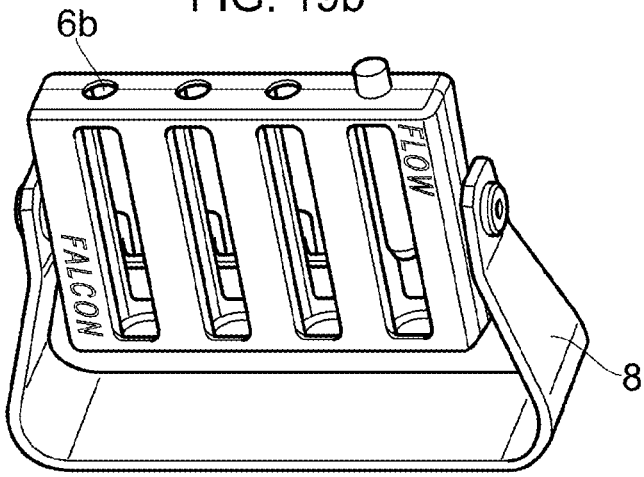
Figure 20:
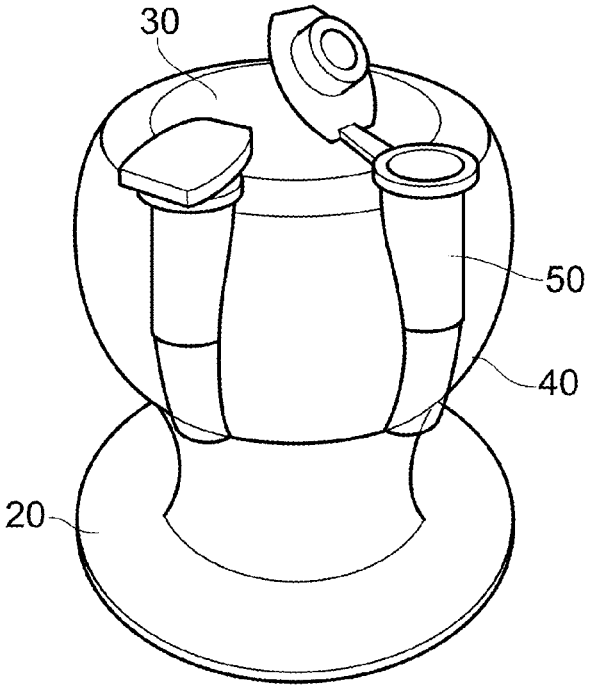
FIG. 20 is a perspective view of a first embodiment of a second type of magnetic separating device according to the disclosure.

In FIGS. 19*a-c* the same magnetic separation device is arranged to receive and retain sample vessels of a second different predetermined size, e.g. "flow" test-tubes such as flow cytometry tubes available from B. D. Falcon, New Jersey. U.S.A. These particular sample vessels are smaller in size, i.e. thinner and shorter, than the sample vessels of the first predetermined size. The sample vessels of the second predetermined size are mountable within the sample vessel retaining portions (2) via the second apertures (6*b*) that are formed on the lower surface (1*b*) of the body portion (1). Hence, the body portion (1) is pivoted with respect to the foot portion (8) such that the second apertures (6*b*) formed in the lower surface (1*b*) of the body portion (1) are arranged upper side. The sample vessels of the second predetermined size are substantially shorter than the passage of the sample vessel retaining portion. Therefore, the sample vessel supporting member (10) is required to support the tip of the sample vessel within the passage (7). The sample vessel supporting member (10) is pivoted to the second position such that a supporting portion (11) of the member extends substantially across the width of each passage. Thus, when the sample vessels of a second predetermined size are mounted in the sample vessel retaining portions the tips of the sample vessels are supported and the sample vessel is suitably retained.

A skilled person will appreciate that it will not be necessary to orientate the body portion by rotating the body portion or pivoting it around axis A if the first and second sample vessels have the same width but different lengths.

The magnetic separation device may comprise an aperture defining element (12) to further define the predetermined width of a sample vessel (4) that may be received and retained in each sample vessel retaining portion (2). The aperture defining element comprises a plurality of aperture defining portions. Each aperture defining portion comprises a plurality of aperture segments of different predetermined widths. For example, the aperture defining element (12) depicted in FIGS. 13*a-c* and 14 comprises four aperture defining portions (12*a*, 12*b*, 12*c*, 12*d*) and each aperture defining portion comprises two aperture segments (13, 14) of two different predetermined widths. The first aperture segment (13) has a bigger predetermined width than the second aperture segment (14). Each aperture segment may be discrete or the aperture segments may be partially merged or overlapping, for example as illustrated in FIGS. 13*a-c* and 14.

The aperture defining element (12) is preferably a frame or housing-like structure that is mountable around the body portion (1). The aperture defining element (12) comprises an upper surface (12*x*) and preferably a lower surface (12*y*). When the aperture defining element is mounted on the body portion (1) the upper surface (12*x*) of the aperture defining element (12) is arranged in juxtaposition with the upper surface (1*a*) of the body portion (1). Hence, the plurality of aperture defining portions (12*a-d*) formed in the upper surface (12*x*) of the aperture defining element (12) are arranged adjacent to the apertures of the sample vessel retaining portions (2) formed on the upper surface of the body portion (1).

The aperture defining element (12) and body portion (1) are relatively movable. For example, the frame or housing-like structure of the aperture defining element (12) may move, e.g. slide, relative to the body portion (1). Alternatively, the body portion (1) may move, e.g. slide, relative to the aperture defining element.

The aperture defining element (12) and body portion (1) are relatively movable between a plurality of user selectable positions. The number of user selectable positions will normally be equal to the number of aperture segments. In any given position, an aperture segment with a desired width is selected and aligned with respect to an aperture and passage of each sample vessel retaining portion. Hence, the selected aperture of the aperture defining element (12) determines the width of the sample vessel (4) that may be received and retained in the sample vessel retaining portion (2).

In the embodiment of the magnetic separation device depicted in FIGS. 13*a-c* and 14 the body portion (1) is arranged such that it can slide horizontally along axis A relative to the aperture defining element (12). Since the aperture defining portions (12*a-d*) only have two aperture segments (13, 14), the body portion (1) is movable between one of two positions. In the first position, the first larger aperture segment (13) is aligned with respect to the sample vessel receiving portions on the body portion (1) and in the second position smaller aperture segment (14) is aligned with respect to the sample vessel receiving portions on the body portion (1). Hence, when the body portion (1) is moved to the first position then sample vessels (4) with a first predetermined width may be mounted within the rack. When the body portion (1) is moved to the second position then sample vessels (4) with a second predetermined width may be mounted in the device.

In FIGS. 15*a* and 15*b* it can be seen that an embodiment of the magnetic separation device may be configured such that the body portion (1) is movable between two positions such that the magnetising device may retain wider "Falcon" test-tubes (when the body portion (1) is moved to the right relative to the aperture defining element 12)) and narrower "Flow" test-tubes (when the body portion (1) is moved to the left relative to the aperture defining element (12)).

Similarly to FIGS. 15*a* and 15*b*, FIG. 16 depicts an embodiment of the magnetic separation device whereby the body portion (1) is also movable with respect to an aperture defining element (12) such that "Falcon" test-tubes and "Flow" test-tubes may be mounted in the magnetic separating device. However, in this particular embodiment, the frame-like structure of the aperture defining element is configured such that a lower surface (12*y*) acts as a foot portion such that the device may stand on a supporting surface.

The particles to be isolated in a sample may be magnetically labelled using conventional labelling means. For example, the sample may be mixed with magnetic beads that bind to or coat the target particles of interest during a short incubation. The target substances may be, for example, DNA, RNA, mRNA, proteins, bacteria, viruses, cells, enzymes, pesticides, hormones or other chemical compounds.

In operation, a sample is initially incubated with magnetic labelling means such that the particles to be magnetically targeted are rosetted. After incubation, the magnetic separation rack is used to isolate the magnetically labelled particles from the non-magnetic medium. The sample vessel retaining portion is mounted on the magnetising portion such that the sample, contained within at least one sample vessel retained on the sample vessel retaining portion, is subject to a high-gradient magnetic field. The magnetically labelled particles are attracted by the magnetic field and consequently migrate to regions of the internal surface of the sample vessel adjacent the first and second magnetic members (3*ma*, 3*mb*). This enables the easy removal of the non-magnetic supernatant, possibly using a pipette, whilst the magnetically labelled particles are left isolated in the sample vessel. After washing, the target particles may be used in further studies (positive particle isolation). Magnetic separation may also be used to remove unwanted magnetic particles from a suspension such that substances remaining in the supernatant that is now depleted of the target particles can be used (negative isolation).

Embodiments of a Magnetic Separation Device Comprising a Magnetising Portion

FIGS. 20 to 30 depict embodiments of a second type of magnetic separation device comprising the magnetising portion. In these embodiments, the magnetic separating device comprises of a sample vessel retaining portion (40) and a body portion (10) having a foot portion (20) and the magnetising portion (30) according to the present disclosure.

Figure 21:
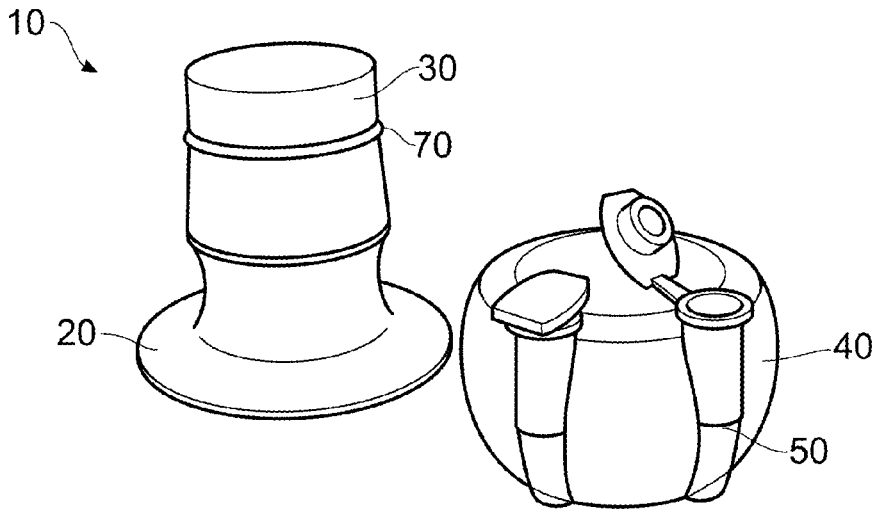
FIG. 21 is a perspective view of a body portion and a sample vessel retaining portion of the second type of magnetic separating device of FIG. 20.
Figure 22:
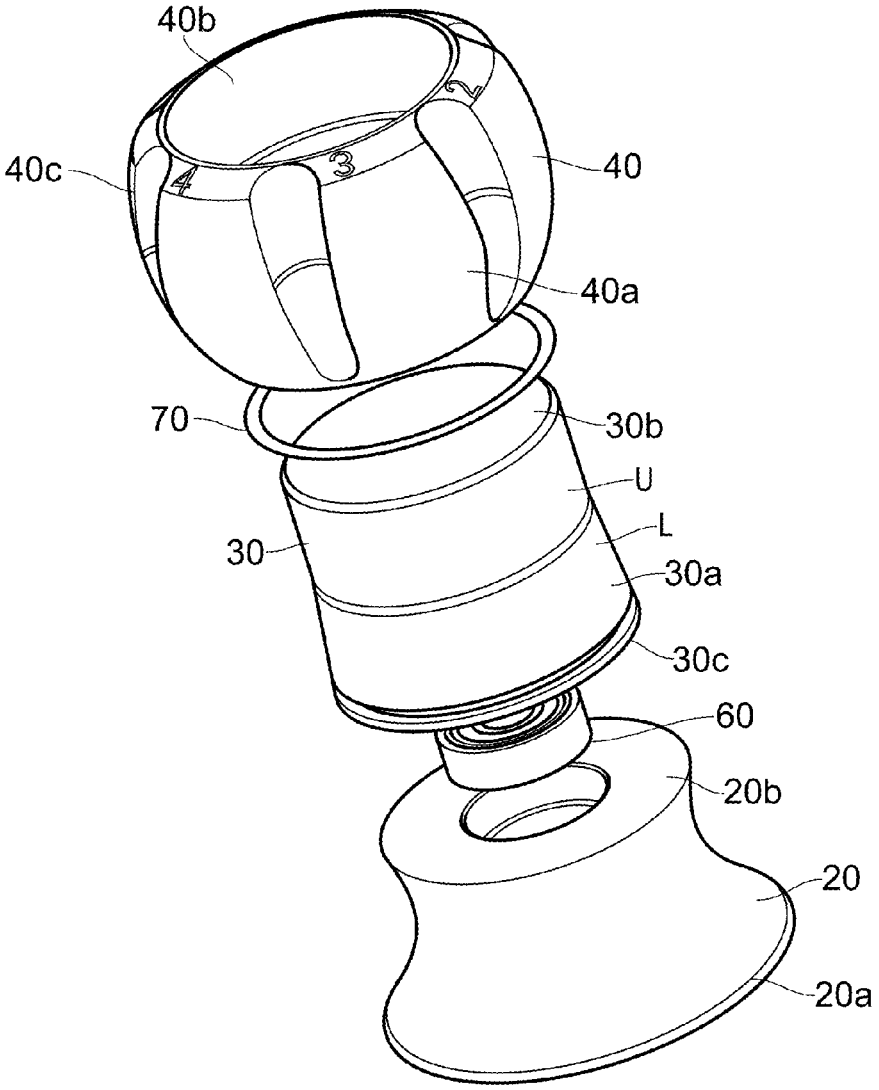
FIG. 22 is a schematic, exploded, perspective view of the second type of magnetic separating device of FIG. 20.
Figure 23A:
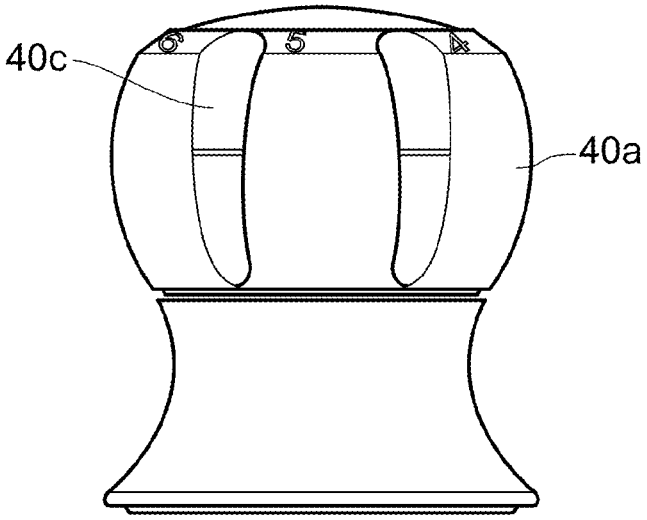
FIGS. 23*a* and 23*b* are a side-view and plan view respectively of the second type of magnetic separating device of FIG. 20.
Figure 23B:
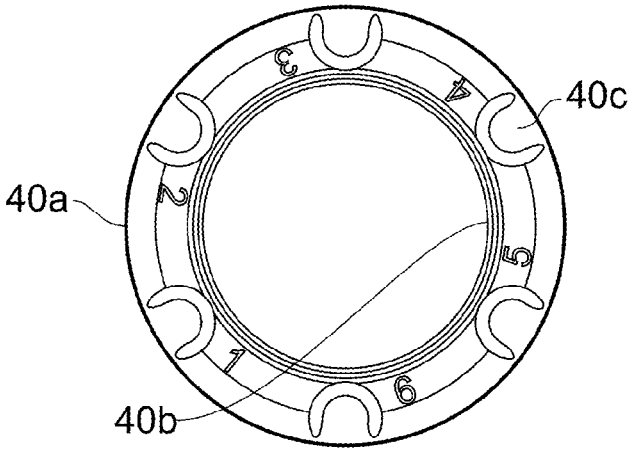

The foot portion (20) is configured to stand on a supporting surface such as a work station, shelf, table or the like. In its simplest form, the foot portion (20) may be a surface by which the body portion (10) may stand on a supporting surface. In the embodiments depicted in FIGS. 20 to 26*c*, the foot portion comprises a lower surface (20*a*) that is configured to stand on a supporting surface. The foot portion (20) and magnetising portion (30) may be separate elements. The foot portion (20) and magnetising portion (30) may be releasably coupled. The foot portion (20) may comprise an upper surface (20*b*) that is arranged in confronting relation with a lower surface (30*c*) of the magnetising portion (30) as shown in FIGS. 22 and 24*a*. In FIGS. 26*a*-26*d*, the foot portion (20) comprises a first foot member (20*x*) and a second foot member (20*y*). The feet members (20*x*, 20*y*) are arranged in juxtaposition with the two opposing side walls (30*a*) of the magnetising portion. Each foot member (20*x*, 20*y*) comprises a lower surface (20*a*) that is configured to stand on a supporting surface, an inner side wall that is arranged in confronting relation with a side wall (30*a*) of the magnetising portion and an outer side wall that is configured such that it may be arranged in confronting relation with the inner surface of the side-walls (90, 91) of the sample vessel retaining portion (40). Alternatively, the foot portion (20) and magnetising portion (30) may be provided as a unitary component as shown in FIG. 25*a*.

The magnetising portion (30) comprises at least one magnetic assembly (3*m*). The at least one magnetic assembly provides a high-gradient magnetic field that is suitable for attracting and separating magnetically labelled particles from a fluid in which they are suspended.

The at least one magnetic assembly (3*m*) is mounted within a housing which defines a void, cavity or chamber for receiving the at least one magnetic assembly. The housing has an external wall which may comprise at least one side-wall that extends between a top margin, point or boundary of the housing and a bottom margin, point or boundary of the housing. In the embodiment depicted in FIGS. 20 to 23*b*, the housing of the magnetising portion (30) has a closed cylinder-like shape with a side-wall (30*a*), an upper surface (30*b*) and a lower surface (30*c*). In the embodiments depicted in FIGS. 24*a* to 26*d*, the housing of the magnetising portion (30) has a closed cuboid-like shape with four side walls (30*a*), an upper surface (30*b*) and a lower surface (30*c*).

The magnetising portion (30) may be rotatable with respect to the foot portion (20). The body portion (10) may comprise a rotatable mounting member to rotatably mount the magnetising portion (30) with respect to the foot portion (20). The rotatable mounting member may be any conventional means suitable for rotatably mounting the magnetising portion. For example, FIG. 22 indicates the rotatable mounting member may be a ball-bearing and socket arrangement (60) disposed between a void or recess formed in the lower surface (30*c*) of the magnetising portion (30) and a void or recess in the upper surface (20*b*) of the foot portion (20).

Clearly, the foot portion (20) and housing of the magnetising portion must be made of a material or materials that are non-magnetic. The foot portion (20) and housing of the magnetising portion are preferably made from the same material and/or a material that is easy to clean and resistant to disinfectant and/or other aggressive chemicals. For example, the foot portion (20) and housing of the magnetising portion may be made from a plastics material such as an ABS plastic.

The sample vessel retaining portion (40) is suitable for retaining at least one sample vessel (50). The sample vessel retaining portion (40) is configured such that it may receive and thereby be mounted on the magnetising portion (30). The sample vessel retaining portion (40) is releasably mountable on the magnetising portion (30). As the sample vessel retaining portion (40) receives the magnetising portion (30) the sample vessel retaining portion (40) is externally mounted on the body portion (10). In its simplest form the sample vessel retaining portion (40) is a female part that is configured to receive the male magnetising portion (30). When the sample vessel retaining portion (40) receives the magnetising portion (30) a sample vessel (50) retained by the sample vessel retaining portion (40) is arranged proximate at least one magnetic assembly (3*m*) of the magnetising portion (30) such that it is subject to the high-gradient magnetic field. Consequently, the magnetically labelled particles suspended within a sample are attracted by the magnetising portion (30) and immobilised at selected regions along the interior surface of the sample vessel (50). These selected regions are sections or zones of the interior surface of the sample vessel (50) adjacent the at least one magnetic member (3*m*) of the magnetising portion; i.e. regions of the interior surface closest to the at least one magnetic assembly (3*m*) mounted within the magnetising portion.

Figure 27A:
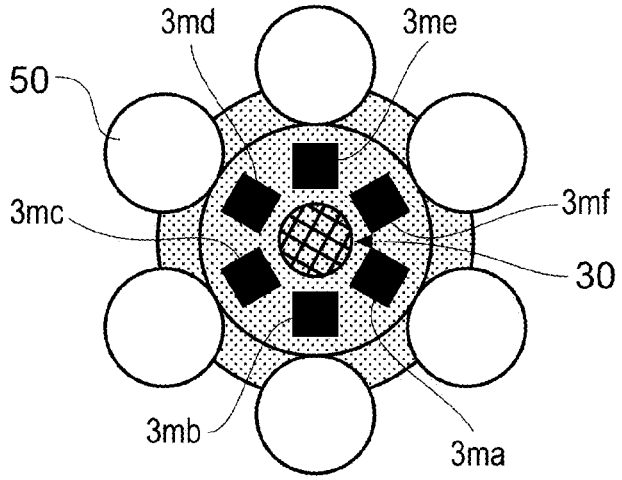
FIGS. 27*a* and 27*b* are a plan view and side-view respectively showing a first arrangement of two sample vessels with respect to the magnetising portion.
Figure 27B:
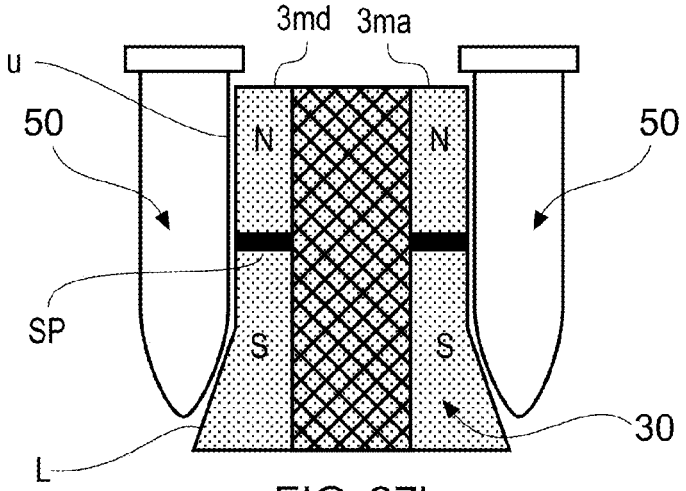

As mentioned above, the magnetising portion (30) comprises at least one high-gradient magnetic assembly (3*m*). The at least one magnetic assembly is mounted within the housing of the magnetising portion (30) such that when the at least one sample vessel (50) is mounted on the sample vessel retaining portion (40) the sample vessel (50) is subject to a high-gradient magnetic field. The at least one magnetic assembly may be shaped and arranged such that at least the main volume of the sample vessel (50) is subject to a high-gradient magnetic field. In FIGS. 27*a* and 27*b*, a plurality of magnetic assembly (3*ma*-3*me*) is mounted within the housing of the magnetising portion (30) and arranged such that a magnetic assembly is adjacent each formation. This arrangement is suitable for use in any of the magnetic separation devices depicted in FIGS. 20 to 26*b*.

Figure 27C:
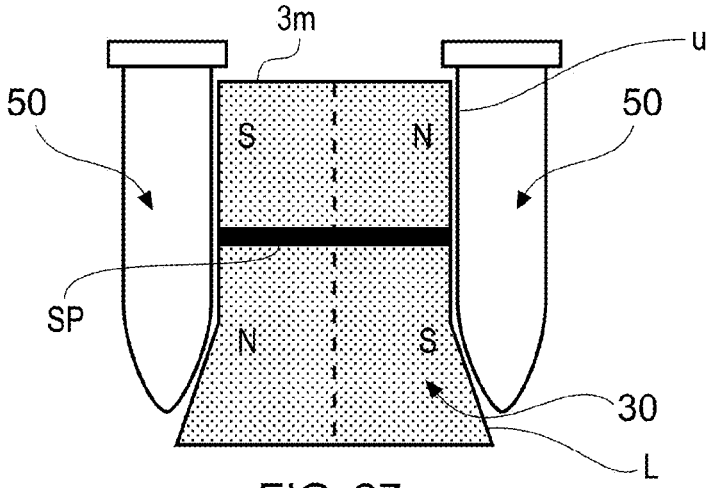
FIG. 27*c* is a side-view shown a second arrangement of two sample vessels with respect to the magnetising portion.

In FIG. 27*c*, a magnetic assembly is mounted within the housing of the magnetising portion (30) and arranged such that a first alternating multipole surface is proximate a first formation and a second alternating multipole surface is proximate a second formation. This arrangement is suitable for use in the magnetic separation devices depicted in FIGS. 24*a* to 26*d*.

In the embodiments depicted in FIGS. 27*a* to 27*c*, each magnetic assembly is shaped and arranged such that both the main volume and tip of a sample vessel mounted within a formation would be subject to a high-gradient magnetic field. The at least one magnetic assembly may be alternatively shaped and arranged within the housing of the magnetising portion (30) such that only the main volume or the tip of the sample vessel (50) is subject to a high-gradient magnetic field.

So as to ensure the a substantial portion of the sample vessel is subject to a high-gradient magnetic field the magnetising portion (30) of the magnetic separation device may be configured to conform at least approximately to at least a substantial portion of the longitudinal profile of at least a sample vessel (50). Preferably, the external wall of the housing is configured to conform at least approximately to at least a substantial portion of the longitudinal profile of at least a sample vessel. More specifically, the at least one side wall (30*a*) of the external wall that is arranged in confronting relation with the sample vessel is configured to conform at least approximately to at least a substantial portion of the longitudinal profile of the at least one sample vessel. The external wall may comprise a first portion that is configured to conform at least approximately to the longitudinal profile of the main volume of a sample vessel and a second portion that is configured to conform at least approximately to the longitudinal profile of the tip of a sample vessel. FIGS. 27*a* to 27*c* depict how a plurality of sample vessels (50) may be arranged circumferentially with respect to a magnetising portion (30) that has been configured to conform at least approximately to at least a substantial portion of the longitudinal profile of the sample vessels. The external wall of the magnetising portion (30) is configured such that it follows the contours of, that is it conforms to, the longitudinal profile of the sample vessels. The external wall comprises an upper wall portion (U) that is substantially vertical that conforms at least approximately to the longitudinal profile of the main volume region of the sample vessels. The external wall also comprises a lower wall portion (L) that is inclined with respect to the upper wall portion and conforms at least approximately to longitudinal profile of the tip region of the sample vessels. The external wall of the magnetising portion (3) depicted in the embodiments of FIGS. 20-26*d* comprises an upper portion (U) that is substantially vertical and conforms at least approximately to longitudinal profile of the main volume region of the sample vessels and a lower portion (L) that is inclined with respect to the upper wall portion and conforms at least approximately to the longitudinal profile of the tip region of the sample vessels.

The magnetising portion may alternatively or additionally be configured to conform at least approximately to at least a substantial portion of the longitudinal profile of a sample vessel by arranging and/or shaping the at least one magnetic assembly (3*m*) mounted within the housing of the magnetising portion (30) and/or by arranging and/or shaping the at least one magnet of the magnetic assembly (3*m*). The at least one magnetic assembly (3*m*) and/or at least one magnet of the magnetic assembly may be arranged and/or shaped such that at least one face of the at least one magnetic assembly/magnet conforms at least approximately to at least a substantial portion of the longitudinal profile of the sample vessel. The magnetic assembly and/or magnet may be arranged and/or shaped such that it has a face which follows the longitudinal contours or profile of the main volume and/or tip of the sample vessel—as depicted in FIGS. 27*a* and 27*b*.

Configuring the magnetising portion (30) to conform at least approximately to at least a substantial portion of the longitudinal profile of at least one sample vessel (50) alleviates and/or overcomes some of the problems associated with prior art magnetic separation devices. By configuring the magnetising portion a sample vessel (retained in the sample vessel retaining portion when mounted on the magnetising portion) is subject to an improved high-gradient magnetic field. The sample vessel is subject to a higher-gradient magnetic field than the prior art because the sample vessel is arranged in closer proximity to the magnetising portion. Moreover, a greater portion of the sample vessel is subject to the higher-magnetic field because a more substantial length of at least one sample vessel is arranged in closer proximity to the magnetising portion than in the prior art. For example, both the main volume and the tip of the sample vessel are arranged in closer proximity to the magnetising portion. As a result, the high-gradient magnetic field is more consistent along a substantial length of the sample vessel (e.g. the main volume and the tip). Since the sample vessel is subject to an improved to a higher-gradient magnetic field and a more substantial length of the sample vessel is subject to a more consistent high-gradient magnetic field, magnetically labelled particles may be attracted by the magnetising portion from all parts of the sample and the selected regions of immobilised magnetically labelled particles may be found along the interior surface of a substantial length of the sample vessel. Also, it has been found that by specifically configuring the magnetising portion such that it conforms at least approximately to a substantial portion of the longitudinal profile of the tip of the at least one sample vessel, the magnetic separation of magnetically labelled particles in small sample volumes is improved. Due to the configuration of the magnetising portion the accuracy and efficiency of the magnetic separation device is improved.

The sample vessel retaining portion (40) has both an external wall (40*a*) and an internal wall (40*b*). The external wall (40*a*) of the sample vessel retaining portion may be shaped and configured such that it comprises at least one side-wall extending between a top margin or boundary and a bottom margin or boundary. For example, the sample vessel retaining portion (40) may have an open cylinder-like shape with an aperture extending from the top to the bottom so as to define the external and internal walls (40*a*, 40*b*) (see FIGS. 21 and 22). In the embodiment of the disclosure depicted in FIGS. 20 to 23*b* the external wall (40*a*) comprises a curved side-wall.

The sample vessel retaining portion (40) may be alternatively shaped and configured such that the internal wall (40*b*) defines a recess or cavity space to receive the magnetising portion (30).

Figure 24B:
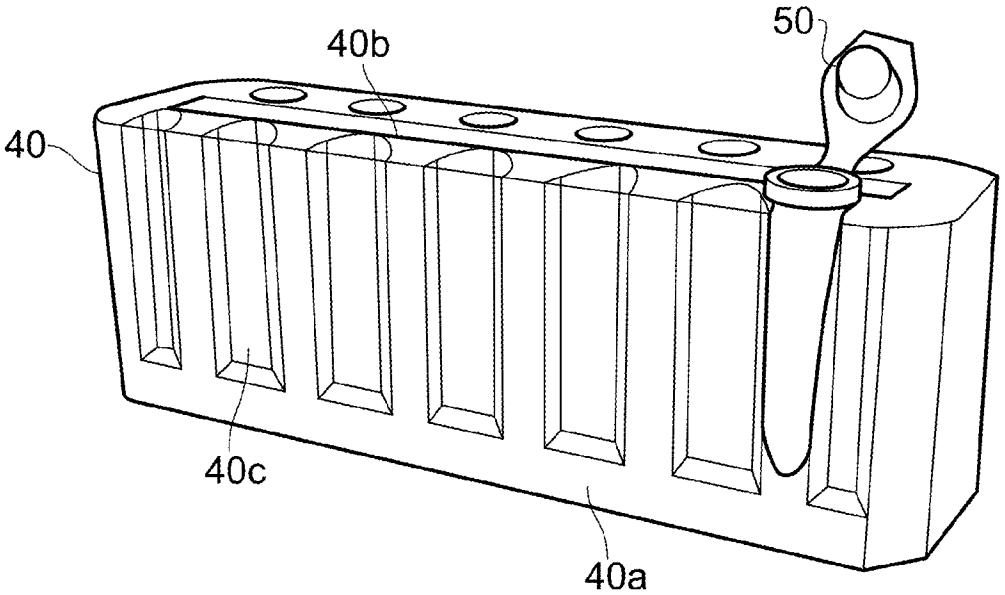
FIGS. 24*a* and 24*b* are an exploded perspective view and a perspective view respectively of a second embodiment of the second type of magnetic separating device according to the disclosure.
Figure 24A:
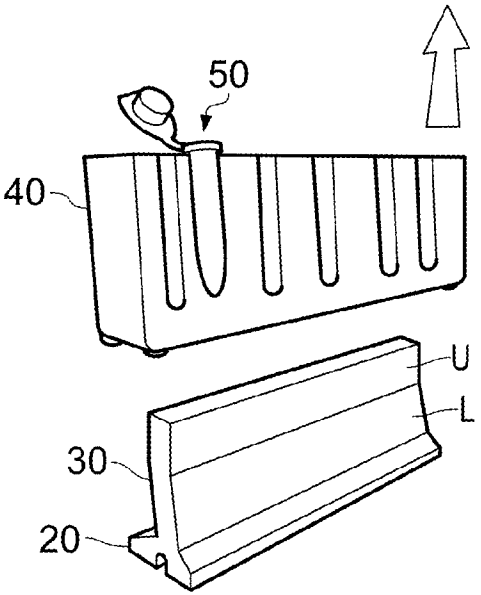
Figure 25A:
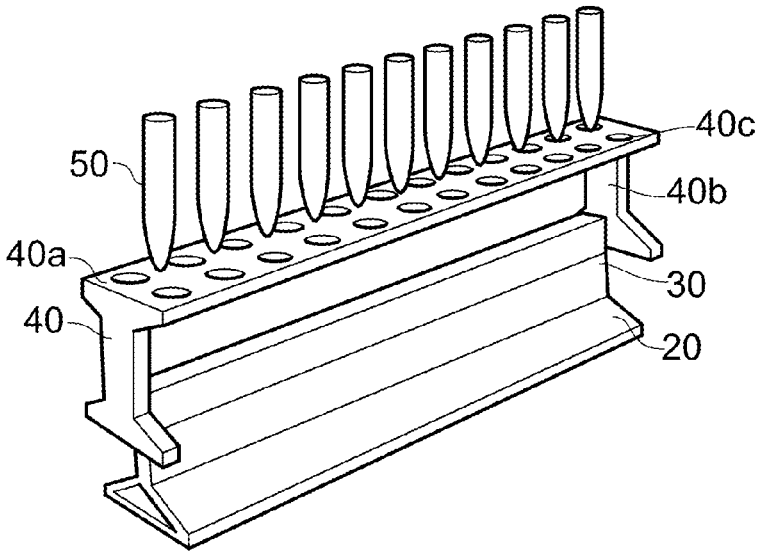
FIGS. 25*a* and 25*b* are an exploded perspective view and a perspective view respectively of a third embodiment of the second type of magnetic separation device according to the disclosure.
Figure 25B:
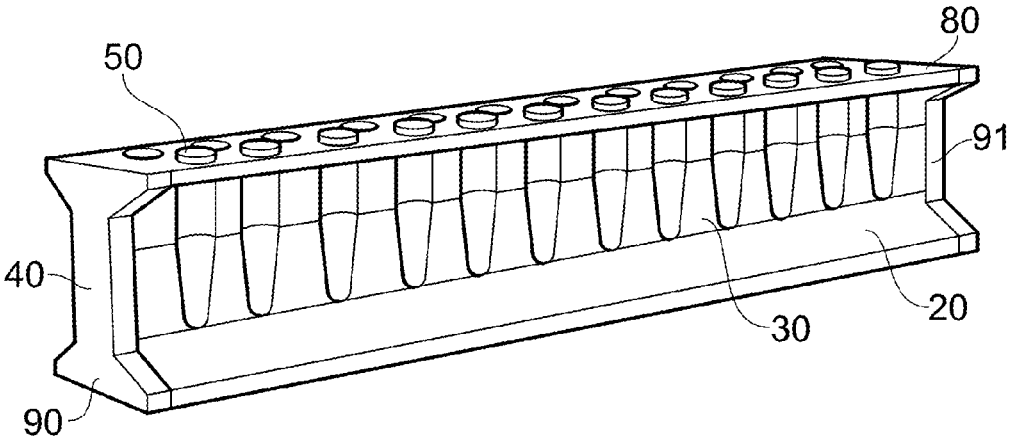
Figure 26A:
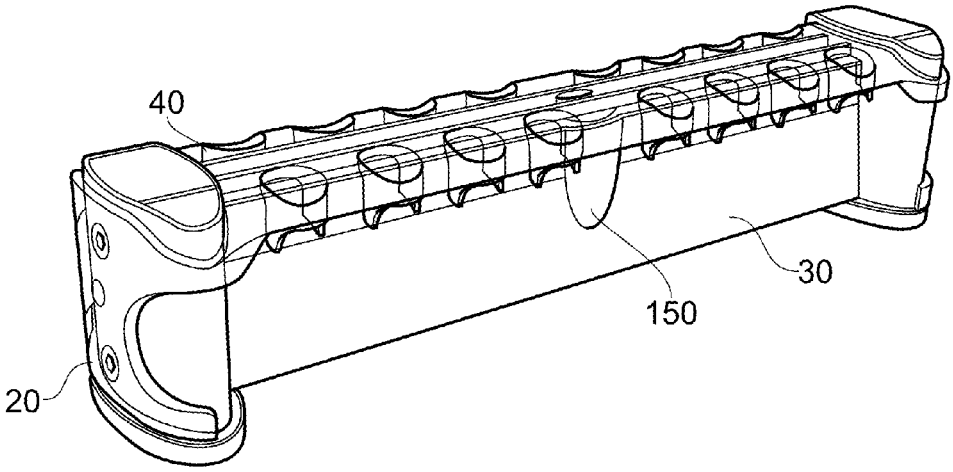
FIGS. 26*a* is a perspective view of a fourth embodiment of the second type of magnetic separation device according to the disclosure.
Figure 26B:
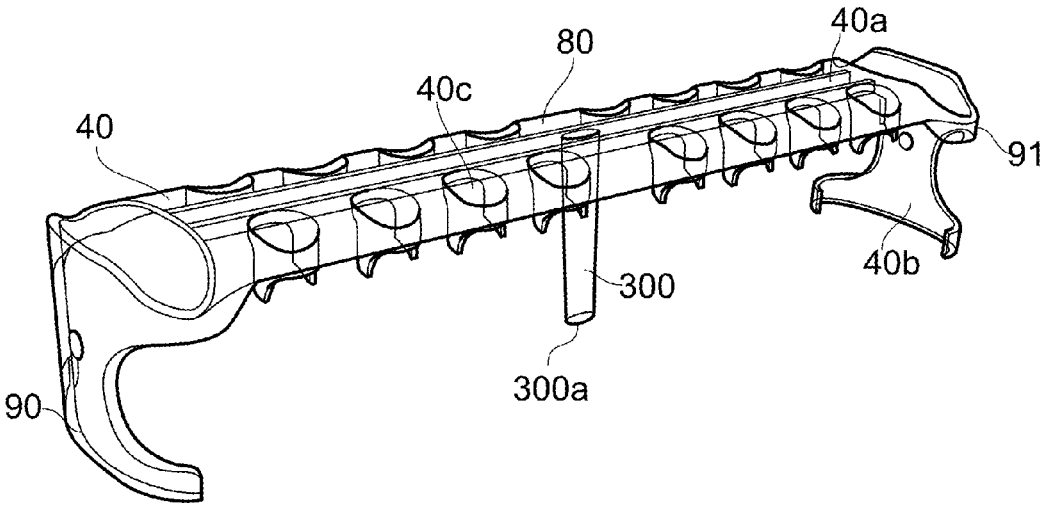
FIGS. 26*b* and 26*c* are perspective views of the sample vessel retaining portion and the body portion respectively of the fourth embodiment of the second type of magnetic separation device and FIG. 26*d* is a schematic, exploded, perspective view of the fourth embodiment of the second type of magnetic separation device according to the disclosure.
Figure 26C:
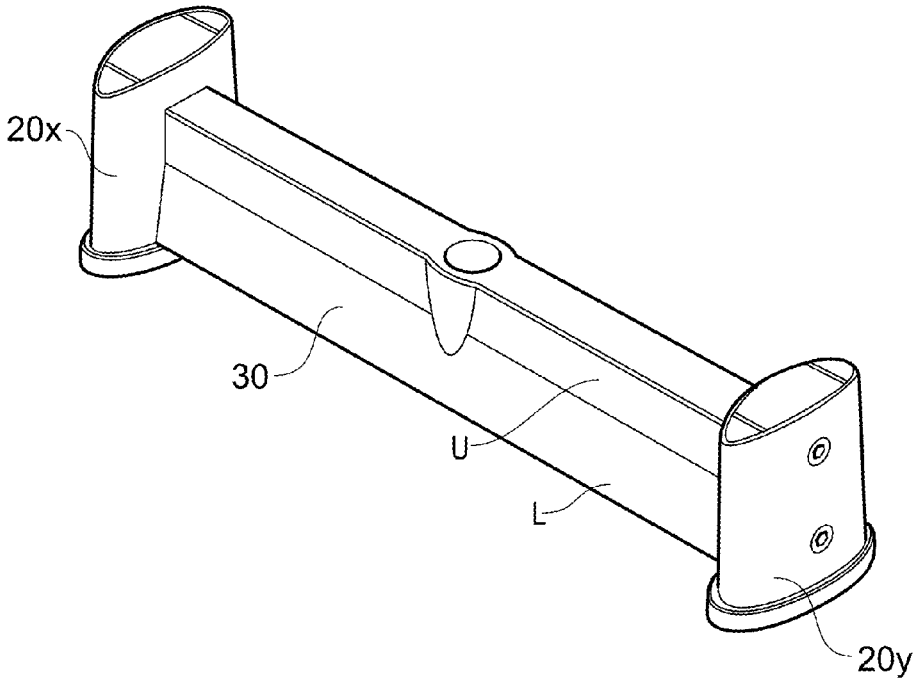
Figure 26D:
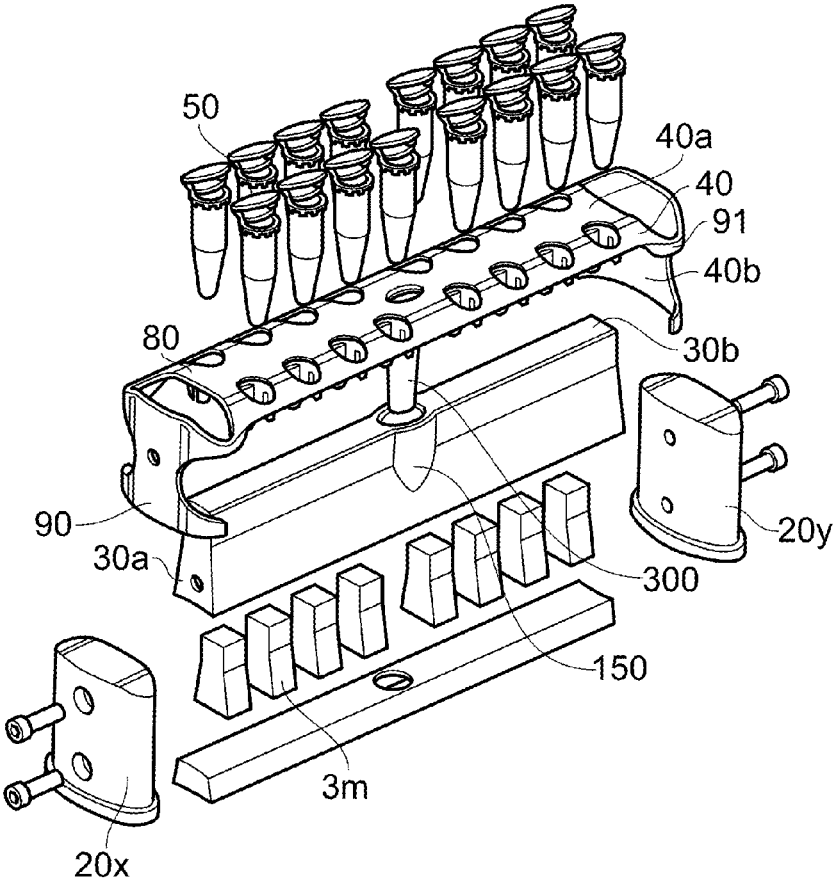

In the embodiment of the magnetic separation device depicted in FIGS. 24*a* and 24*b*, the sample vessel retaining portion (40) has a housing-like structure with an open cuboid-like shape. This particular sample vessel retaining portion (40) has an aperture extending from the top to the bottom of four side walls so as to define the external and internal walls (40*a*, 40*b*).

In the embodiment of the magnetic separation device depicted in FIGS. 25*a* to 26*d*, the sample vessel retaining portion (40) has a frame-like structure that is generally U-shaped. The sample vessel retaining portion (40) comprises a cross-member (80), a first side-wall (90) extending substantially from a first end of the cross-member (80) and a second side-wall (10) extending substantially vertically from a second end of the cross-member (80). The upper surface of the cross-member (80) and outer-surfaces of the side-walls (90, 91) define the external wall (40*a*) of the sample vessel retaining portion (40). The lower surface of the cross-member (80) and inner surfaces of the side-walls (9, 91) define the internal wall (40*b*) of the sample vessel retaining portion (40).

When the female sample vessel retaining portion (40) receives the male magnetising portion (20) the internal wall (40*b*) of the sample vessel retaining portion (40) is in juxtaposition with the external wall of the magnetising portion (30). For example in the embodiment depicted in FIGS. 20 to 23*b*, the internal wall (40*b*) of the open cylinder-like sample vessel retaining portion (40) is located in juxtaposition with the side-wall (30*a*) of the closed cylinder-like magnetising portion (30). Likewise, in the embodiment depicted in FIGS. 24*a* and 24*b*, the internal wall (40*b*) (inner surface of the four side walls) of the open cuboid-like sample vessel retaining portion (40) is located in juxtaposition with the four side walls (30*a*) of the closed cuboid-like magnetising portion (30). In the embodiment depicted in FIGS. 25*a* and 25*b*, the internal wall (40*b*) (lower surface of the cross-member (80) and inner surface of the side-walls (90, 91) of the generally U-shaped sample vessel retaining portion (40)) is located in juxtaposition with the upper surface 30*b* and two opposing side walls (30*a*), i.e. a certain portion of the external wall of the closed cuboid-like magnetising portion (30). Moreover, in the embodiment depicted in FIGS. 26*a*-26*d*, the internal wall (40*b*) (lower surface of the cross-member (80) and inner surface of the side-walls (90, 91) of the generally U-shaped sample vessel retaining portion (40)) is located in juxtaposition with the upper surface 30*b* of the closed cuboid-like magnetising portion (30) and two opposing side walls of the feet members (20*a*, 20*b*).

The magnetic separating device may further comprise at least one coupling member which serves to releasably secure the female sample vessel retaining portion (40) to the male magnetising portion (40). The coupling member may comprise conventional latching means, snap-fitting means or spring-lock mechanism to mechanically engage the portions. The coupling member may alternatively or further comprise conventional means by which the portions are frictionally engaged. FIGS. 21 and 22 depict an O-ring (70) mounted on the side-wall (30*a*) of the magnetising portion (30) such that the female sample vessel retaining portion (40) and male magnetising portion (30) frictionally engage when the female sample vessel retaining portion (40) receives the male magnetising portion (30).

The magnetic separating device may comprise a releasable engaging means whereby the sample vessel retaining portion (40) can be mounted at any selected one of a range of mounting positions on the magnetising portion (30). By having a range of different mounting positions, the arrangement of the at least one sample vessel (50) retained within the sample vessel retaining portion (40) varies with respect to the magnetising portion (30). Hence, different portions of the at least one sample vessel (50) may be subject to the high-gradient magnetic field when the sample vessel retaining portion (40) is mounted in different positions on the magnetising portion (30). For example, the sample vessel retaining portion (40) may be mountable in three different positions on the magnetising portion such that in a first position only the tip of the at least one sample vessel is subject to a high-gradient magnetic field, in a second position both the tip and the main volume of the at least one sample vessel is subject to a high-gradient magnetic field and in a third position only the main volume of the at least one sample vessel is subject to a high-gradient magnetic field. The releasable engaging means may comprise conventional latching means or snap-fitting means to mechanically engage the sample vessel retaining portion (40) and magnetising portion (30) in the selected position.

The sample vessel retaining portion (40) comprises at least one formation (40*c*) for receiving and retaining a sample vessel (50). Preferably, the sample vessel retaining portion comprises a plurality of formations (40*c*) for receiving and retaining sample vessels (50). The at least one formation (40*c*) may be configured to provide an interference fit between the sample vessel (50) and sample vessel retaining portion (40)

In the embodiments depicted in FIGS. 20 to 24*b*, the at least one formation (40*c*) is formed in the external wall (40*a*) of the sample vessel retaining portion (40). The at least one formation (40*c*) is a recess formed on the external wall (40*a*) of the sample vessel retaining portion (40). The recess is shaped and arranged to receive and retain a sample vessel (50). The recess comprises a face which conforms at least approximately to the shape of a sample vessel. The recess may be configured to receive and thereby retain a certain portion of the sample vessel or a substantial portion of the sample vessel. When a sample vessel (50) is received and retained by a recess-type formation it is considered to be mounted in the formation (40*c*) proximate the external wall of the sample vessel retaining portion (40).

FIGS. 25*a* to 26*d* depict embodiments of the disclosure wherein the at least one formation (40*c*) is formed in the cross-member (80) of the sample vessel retaining portion (40). The at least one formation (40*c*) is an aperture that extends through the cross-member between the external wall (40*a*) and the internal wall (40*b*) of the sample vessel retaining portion (40). The aperture may be configured such that a rim of a sample vessel (50) of a predetermined width abuts the peripheral edge of the aperture such that the sample vessel (50) is mounted or retained at the cross-member (80). The sample vessel (50) may be further or alternatively supported by the body portion (10). The body portion (10), specifically the magnetising portion (30) and/or the foot portion (20), is configured such that the tip of the sample vessel (50) may abut the body portion (10) and thereby be supported by the body portion (10). When a sample vessel (50) is received and retained by an aperture-type formation it is considered to be mounted via the formation (40*c*) of the sample vessel retaining portion (40).

In preferred configurations, the formations (40*c*) are arranged in approximately circumferential array about the sample vessel retaining portion (40) and are preferably further configured so that the contents of the sample vessels may easily be observed by a user without removing the sample vessels from the respective formations (40*c*). In the embodiment shown in FIGS. 20 to 23*b*, the sample vessel retaining portion (40) may hold up to six sample vessels around the circumference of the cylindrical external wall (40*a*). Thus, when the sample vessel retaining portion (40) receives the magnetising portion (30), the sample vessels (50) are thereby arranged around the circumference of the magnetising portion (30). Of course, the sample vessel retaining portion (40) may be configured to hold fewer or more sample vessels (50). In FIGS. 23*a* and 23*b*, it can be seen that the formations (40*c*) to receive and retain the sample vessels are numbered one to six. In the embodiments shown in FIGS. 24*a* to 26*d*, a plurality of sample vessels (50) may be arranged in approximately circumferential array around the sample vessel retaining portion (40) such that they are arranged in approximately circumferential array around the cuboid-like shaped magnetising portion (30).

The formations (40*c*) to receive and retain a sample vessel may be configured such that the magnetic separating device is suitable for use with a range of different sized sample vessels. The sample vessel retaining portion (40) may be sized and shaped to retain sample vessels of any conventional size and in particular sample vessels having a diameter up to 30 mm and volumes typically ranging from about 5 to about 50 ml. Alternatively, the sample vessel retaining portion (40) may be configured to retain much smaller vessels, for example 0.5 to 2.0 ml micro centrifuge tubes available from Eppendorf A. G., Hamburg, Germany. The sample vessel retaining portion (40) may be colour coded according to size and/or type of sample vessel (50) it is configured to receive and retain.

As mentioned above, the formations (40*c*) may be configured to receive and retain sample vessels (50) from a selected range of different sized sample vessels. Thus, the magnetic separating device may comprise a plurality of sample vessel retaining portions (40) whereby each respective sample vessel retaining portion is configured to retain at least one sample vessel (50) of a predetermined size.

Clearly, the sample vessel retaining portion (40) must be made from a non-magnetic material. The sample vessel retaining portion (40) is preferably formed from material that is easy to clean and is resistant to disinfectant and/or other aggressive chemicals. The sample vessel retaining portion (40) may also be formed from a material that is resiliently deformable such that the at least one formation resiliently deforms to retain a sample vessel (50). The sample vessel retaining portion (40) may also or alternatively be formed from a material that has high frictional properties such that the at least one formation (40*c*) provides a friction fit. The sample vessel retaining portion (40) may be formed from a at least a substantially transparent material such that the sample vessels (50) may be viewed easily.

In the embodiments of the magnetic separation device disclosure depicted in FIGS. 20 to 24*b*, the formations (40*c*) to receive and retain a sample vessel are formed in the external wall (40*a*) of the sample vessel retaining portion (40). Thus, in use, the at least one sample vessels (50) are arranged around the outer margin of the sample vessel retaining portion (40). By mounting the at least one sample vessel around the external wall (40) of the sample vessel retaining portion (40) the overall design of the magnetic separation devices depicted in FIGS. 20 to 24*b* are much more compact than a conventional linear-rack or tray arrangement. This is a significant space-saving advantage over the prior art.

Mounting the at least one sample vessel on the external wall (40*a*) of the sample vessel retaining portion (40) means that the sample vessel may be viewed more easily—see FIGS. 20 to 24*b*. This is also a significant advantage over prior art magnetic separating devices where sample vessels are mounted within a linear-rack, tray or internal cavity space and the inspection of the samples is somewhat restricted.

Mounting the at least one sample vessel (50) via the formations (40*c*) formed in the cross-member (80) of the generally U-shaped shaped frame means that the sample vessel may be viewed more easily—see FIGS. 25*a* to 26*d*. This is a significant advantage over the prior art magnetic separation devices where sample vessels are mounted within chambers in a linear rack or tray or any other internal cavity space arrangement and the inspection of the samples is somewhat restricted.

Figure 28A:
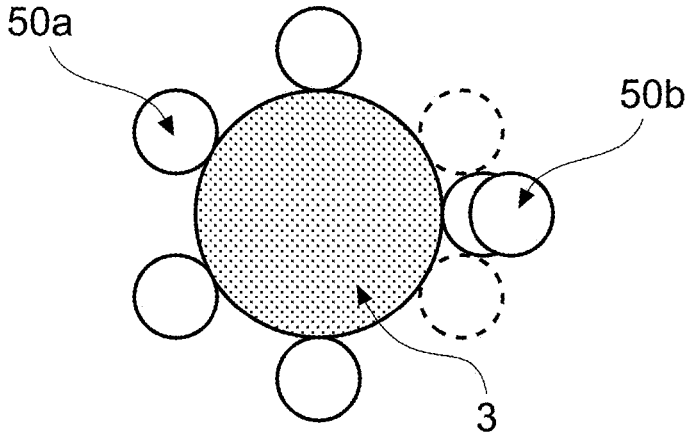
FIGS. 28*a* and 28*b* are a plan view and side-view respectively showing a third arrangement of two sample vessels with respect to the magnetising portion.
Figure 28B:
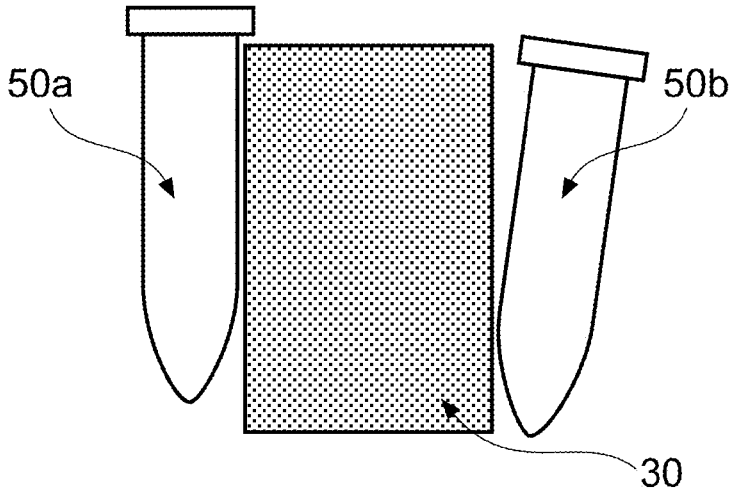

The formations (40*c*) may be configured such that a sample vessel may be received and retained in a first position or a second position within the formation. When retained in the first position, the sample vessel is mounted with respect to the magnetising portion (30) such that at least the main volume of the sample vessel is subject to a high-gradient magnetic field. In the first position, only the main volume or both the main volume and tip of the sample vessel may be subject to the magnetic field. When retained in the second position, the sample vessel is mounted with respect to the magnetising portion (30) such that only the tip of the sample vessel is subject to a high-gradient magnetic field. FIGS. 28*a* and 28*b* depict an embodiment of the disclosure whereby a first sample vessel (50*a*) is retained in a first position within a formation such that both the main volume and tip are subject to the high-gradient magnetic field created by the magnetising portion (3) and a second sample vessel (50*b*) is retained in a second position within a formation such that only the tip of the sample vessel is subject to the high-gradient magnetic field.

Figure 29A:
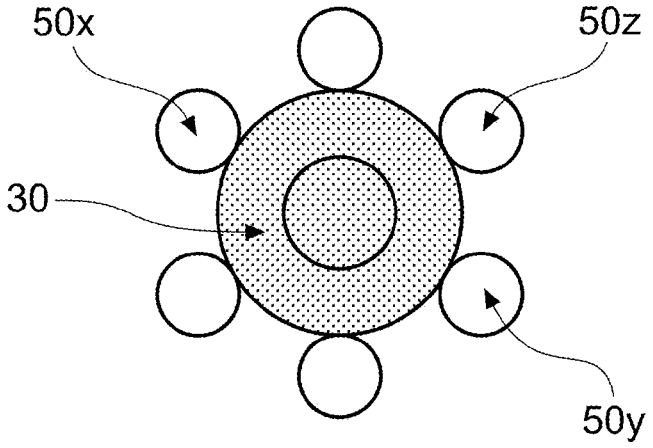
FIGS. 29*a* and 29*b* are a plan view and side-view respectively showing a fourth arrangement of three sample vessels with respect to the magnetising portion.
Figure 29B:
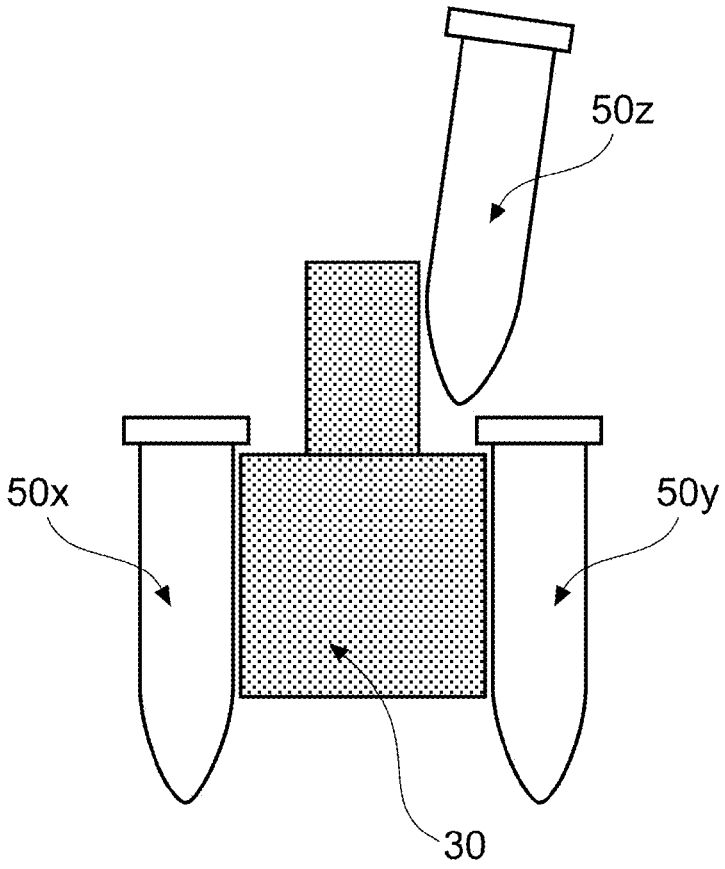

The formations (40*c*) may also or alternatively be configured on the external wall (40*a*) of the sample vessel retaining portion (30) such that the sample vessels (50) may be received and retained in different locations relative to the magnetising portion (30). For example, a formation (40*c*) may be formed at a first location on the sample vessel retaining portion (30) such that at least the main volume of the sample vessel is subject to a high-gradient magnetic field. Alternatively, a formation (40*c*) may be formed at a second location on the sample vessel retaining portion (30) such that only the tip of the sample vessel is subject to a high-gradient magnetic field. FIGS. 29*a* and 29*b* depict an embodiment of the disclosure where a first and second sample vessel (50*x*, 50*y*) are received and retained in a first location on the external wall of the sample vessel retaining portion (30) such that only the main volume of the sample vessels are subject to the high-gradient magnetic field. Also, a third sample vessel (50*z*) is received and retained in a second location on the external wall of the sample vessel retaining portion (30) such that only its tip is subject to the magnetic field.

So as to further improve the visibility, the magnetic separation device may also comprise lighting means to illuminate the at least one sample vessel (50). The lighting means may include one or more light emitting diodes (LED). The one or more LED may be arranged on formation of the sample vessel retaining portion, e.g. within the formation (40*c*), and/or arranged on the body portion (10) without obstructing the entry or exit of the sample vessels (50).

The magnetic separation device may be further or alternatively provided with magnifying means to magnify at least a predetermined region of a sample vessel (50). The magnifying means are preferably arranged such that it magnifies at least a region of the sample vessel. Clearly, the magnifying means are provided to help further improve the visibility of the sample. The magnifying means may be a lens located adjacent the formations (40*c*) of the sample vessel retaining portion (40).

The sample vessel retaining portion (40) of the magnetic separation device may optionally comprise at least one protruding member (300). The at least one protruding member (300) is configured to be contactable with a mixing apparatus (100). More specifically, the at least one protruding member is configured such that it may be arranged in a contacting relationship (confronting relation) with the mixing apparatus (100).

The at least one protruding member is preferably configured such that it comprises a contacting surface (300*a*). The contacting surface (300*a*) is configured such that it can sufficiently contact, touch, mate with or confront a corresponding surface of the mixing apparatus such that a contacting relationship is achieved. The contacting surface (300*a*) is preferably a substantially flat end face surface of the protruding member (300). The contacting surface is preferably configured such that it can contact, touch, mate with or confront an upper surface of an agitating plate (100*a*) of the mixing apparatus (100).

Figure 30:
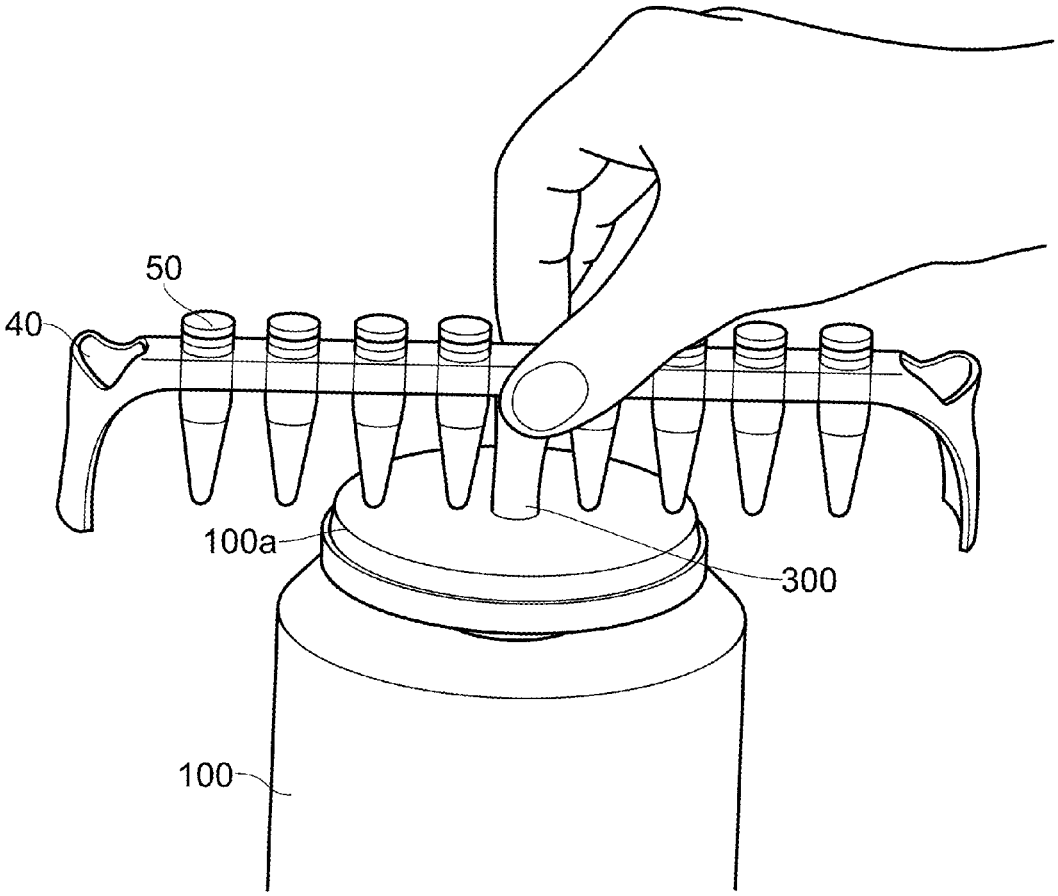
FIG. 30 is a perspective view of the sample vessel retaining portion according to the fourth embodiment of the second type of magnetic separation device arranged in contacting relationship with a mixing apparatus.

In order to mix a sample fluid, the sample vessel retaining portion (40) must be arranged with respect to the mixing apparatus (100) such that the at least one protruding member (30) is in contacting relationship (confronting relation) with the mixing apparatus (100)—see FIG. 30. When the at least one protruding member is arranged in contacting relationship with the mixing apparatus, the agitating motion of the mixing apparatus is transmitted throughout the sample vessel portion via the at least one protruding member. The agitating motion of the mixing apparatus (100) is consequently transmitted to the fluid sample (contained in any sample vessel (50) that is retained in the sample vessel retaining portion (40)). When the fluid sample is subject to the agitating motion of the mixing apparatus, the fluid sample is thereby mixed.

Depending on the type of mixing apparatus, the at least one protruding member (300) may be arranged and maintained in a contacting relationship with the mixing apparatus (100) by manually arranging and holding the sample vessel retaining portion (1) with respect to the mixing apparatus—as shown in FIG. 30. Alternatively, the mixing apparatus (100) may comprise at least one protruding member retaining portion to receive and retain the at least one protruding member (300) of the sample vessel retaining portion (40) such that the at least one protruding member may be arranged and maintained in a contacting relationship with the mixing apparatus (100).

The at least one protruding member (300) preferably has a cylinder-like shape, although it may have a frusto-conical shape, cuboid-like shape, finger-like shape or any other suitable shape. The cylinder-like shaped protruding member preferably has a substantially flat end face suitable for achieving a contacting relationship with the mixing apparatus.

The at least one protruding member (300) is arranged on the sample vessel retaining portion (40) such that the agitating motion of the mixing device is transmitted substantially evenly throughout the sample vessel retaining portion (40). It is important that the agitating motion is transmitted substantially evenly throughout the sample vessel retaining portion so as to ensure that all the fluid samples are mixed to the same degree.

The frequency, amplitude, time period and type of agitating motion can be selected in accordance with the type of fluid sample to be mixed, the type of mixing to be achieved, the size, type and number of sample vessels and the volume of the fluid sample.

FIGS. 26*a-d* and 30 depict an embodiment of the magnetic separation device whereby the sample vessel retaining portion (40) comprises a single protruding member (300). The protruding member extends substantially vertically from the lower surface of the cross-member (80) of the sample vessel retaining portion. The protruding member extends from a substantially central location of the cross-member (80) such that the agitating motion of the mixing apparatus may be transmitted substantially evenly throughout the sample vessel retaining portion. The protruding member has a cylinder-like shape with a substantially flat end face surface. The protruding member is configured such that the substantially flat end face surface can act as a contacting surface (300*a*). FIG. 30 shows that when the sample vessel retaining portion (40) is arranged with respect to the mixing apparatus (100), the protruding member is arranged such that the substantially flat end face surface is in contacting relationship with the upper surface of the agitating plate (100*a*). Thus, in use, the agitating motion of the agitating plate (100*a*) may be transmitted to the fluid samples (contained in the sample vessels (50) that are retained in the sample vessel retaining portion (40)) via the protruding member (300) such that the fluid samples may be mixed.

The protruding member of the sample vessel retaining portion alleviates and/or overcomes some of the problems associated with prior art mixing systems and processes. Not only is the sample vessel retaining portion configured such that a plurality of the fluid samples may be simultaneously agitated and mixed by a mixing apparatus (100), but this particular sample vessel retaining portion of the disclosure is also configured such that the plurality of fluid samples may be simultaneously agitated and thereby mixed whilst the sample vessels remain in-situ in the sample vessel retaining portion during the mixing process—the sample vessels need not be individually and manually transferred from the sample vessel retaining portion to further sample vessel retaining chambers on the mixing apparatus. Due to the at least one protruding member (300), the fluid samples may be mixed merely by arranging the sample vessel retaining portion (40) with respect to the mixing apparatus (100) such that the at least one protruding member is in contacting relationship with the mixing apparatus. Hence, the complexity, process time and risks associated with prior art mixing systems are reduced by using magnetic separation device having a sample vessel retaining portion with at least one protruding member.

The body portion (10) of the magnetic separation device may further comprise at least one cavity (150) that is configured to receive and retain at least one protruding member (300) of the sample vessel retaining portion (40). By configuring the at least one cavity (150) as such the sample vessel retaining portion (40) may be mounted on the body portion (1). In the embodiment depicted in FIGS. 26*a-d*, a cavity (150) is formed in the upper region of the magnetising portion (30). The cavity (150) is configured to receive and retain the protruding member (300) of the sample vessel retaining portion (40).

The particles to be isolated in a sample may be magnetically labelled using conventional magnetic labelling means. For example, the sample may be mixed with magnetic beads that bind to or coat the target particles of interest during a short incubation. The target substance may be, for example, DNA, RNA, mRNA, proteins, bacteria, viruses, cells, enzymes, pesticides, hormones or other chemical compounds.

In operation, a sample and magnetic labelling means are initially placed within a sample vessel. The sample is incubated with magnetic labelling means such that the particles to be magnetically targeted are rosetted. During the incubation period, the sample contained within a sample vessel may be retained by the sample vessel retaining portion. Moreover, the sample vessel retaining portion (40) may be releasably mounted on a non-magnetising portion. The non-magnetising portion is a male part similar to that of the male magnetising portion (30). Hence, the female sample vessel retaining portion (04) may receive and thereby be mounted on the male non-magnetising portion. The non-magnetising portion does not provide a magnetic field. Thus, the magnetic separation device is suitable for use during the incubation period.

At least one coupling member may be provided to releasably engage the sample vessel retaining portion (40) and the non-magnetising portion.

As mentioned above, the foot portion (20) and the magnetising portion (30) may be releasably coupled. Thus, the foot portion (20) and magnetising portion (30) may be uncoupled and the non-magnetising portion may be releasably coupled to the foot portion (20). The body portion (10) maybe configured such that it may be coupled to a mixing apparatus, such as a rotating sample mixer.

Alternatively, the magnetic separation device according to the disclosure may comprise a second body portion comprising the non-magnetising portion and a foot portion. Thus, the sample vessel retaining portion may be mounted on the second body portion during the incubation period. The second body portion may be configured such that it may be coupled to a mixing apparatus such as a rotating sample mixer.

During the incubation period, the sample may require mixing to help mix the magnetic labelling means and subsequently magnetically labelled particles within the sample. As mentioned above the body portion or the second body portion may be configured such that may be coupled to a mixing apparatus. However, if the sample vessel retaining portion comprises at least one protruding member then the sample, the sample vessel retaining portion may be arranged with respect to a mixing apparatus such that the at least one protruding member is in contacting relationship with the mixing apparatus.

As previously mentioned, the at least one magnet of the magnetising portion (30) may be an electromagnet. Clearly, the electromagnet only provides a magnetic field when switched "on". Thus, a skilled person will appreciate that, when the electromagnet is switched "off", the magnetising portion (30) does not provide a magnetic field and sample vessel retaining portion (40) may be mounted on the magnetising portion (30) during the incubation period.

After incubation, the magnetic separation device may be used to isolate the magnetically labelled particles from the non-magnetic sample medium. The sample vessel retaining portion (40) is mounted on the magnetising portion (30) such that the sample contained within the at least one vessel (50) is subject to a high-gradient magnetic field. During the magnetic separation period, the magnetically labelled particles are attracted by the magnetic field and consequently migrate to a region of the internal surface of the sample vessel adjacent the magnetising portion. This enables the easy removal of the non-magnetic supernatant, possibly using a pipette, whilst the magnetically labelled particles are left isolated in the sample vessel. After washing, the target particles may be used in further studies (positive particle isolation). Magnetic separation may also be used to remove unwanted magnetic particles from a suspension such that substances remaining in the supernatant that is now depleted of the target particles can be used (negative isolation).

By configuring the magnetic separation device such that both the main volume and the tip of a sample vessel are subject to a high-gradient magnetic field, the magnetic separation device is suitable for isolating magnetically labelled particles in both larger volumes and smaller volumes of a sample contained in the same sample vessel. For example, the magnetic separating device may process a sample which substantially fills the sample vessel by subjecting both the tip and main volume of a sample vessel, to a high-gradient magnetic field. After isolating the magnetically labelled particles and removing the supernatant using a pipette, the magnetically labelled particles may be released/separated from the magnetic labelling means using a release-buffer. This may be achieved by adding a small volume of release-buffer to the isolated magnetically labelled particles remaining in the sample vessel. Hence, the same sample vessel may now contain only a small volume filling substantially the tip of the sample vessel. The magnetic separating device may then be used to subject the tip of the sample vessel to a high-gradient magnetic field such that the magnetic labelling means separate from the particles and migrate to a region of the internal surface of the sample vessel adjacent the magnetising portion. The particles released/separated from the magnetic labelling means may then be removed from the sample vessel, e.g. using a pipette.

The magnetic separation devices as herein described are inherently advantageous and as such may also be usefully used with any other suitable magnetising portion or means to provide a suitable high-gradient magnetic field.

The invention claimed is:

1. A magnetic separation device comprising:

a first and a second magnetic assembly, each comprising:

a plurality of magnets wherein:

each of the plurality of magnets has a north pole, south pole and a magnet axis extending between the north and south poles;

the plurality of magnets are arranged one above the other in a direction at least substantially perpendicular to the axis of each of the plurality of magnets in such a manner that north poles are over south poles;

a space is provided between adjacent magnets;

the surfaces of adjacent magnets do not touch; and at least one non-magnetic spacing means arranged in the space between adjacent magnets; and a sample vessel retaining portion including a substantially circular aperture formed in an upper surface of a body portion suitable for receiving sample vessels;

wherein the first and second magnetic assemblies are positioned on opposite sides of the sample vessel retaining portion;

wherein the north pole of a magnet in the first magnetic assembly is directed toward the south pole of a magnet in the second magnetic assembly in an attractive configuration.

2. The magnetic separation device according to claim 1 wherein the at least one non-magnetic spacing means comprises aluminium or a plastics material.

3. The magnetic separation device according to claim 1 wherein the at least one non-magnetic spacing means is an air gap.

4. The magnetic separation device according to claim 1 wherein the plurality of magnets comprise a permanent magnetic material or a ferrous magnetic material.

5. The magnetic separation device according to claim 1 wherein each of the plurality of magnets comprises a first pole surface and a second pole surface and the first pole surface and/or the second pole surface of at least one of the plurality of magnets is shaped to follow the contour of a sample vessel.

6. The magnetic separation device according to claim 1 wherein the adjacent magnets are further spaced apart by a distance in a direction that is substantially parallel to the longitudinal axis of the magnetic assembly and substantially perpendicular to the axis of each magnet.

7. A magnetic separation device for isolating magnetically labelled particles from a non-magnetic medium comprising a body portion having:

an array of sample vessel retaining portions including a substantially circular aperture formed in an upper surface of the body portion suitable for receiving sample vessels; and a plurality of magnetising portions arranged within the body portion such that a first and a second magnetic assembly are circumferentially spaced about and on opposite sides of the each sample vessel retaining portion wherein each magnetic assembly comprises:

a plurality of magnets wherein:

each of the plurality of magnets has a north pole, south pole and a magnet axis extending between the north and south poles;

the plurality of magnets are arranged one above the other in a direction at least substantially perpendicular to the axis of each of the plurality of magnets in such a manner that north poles are over south poles; and wherein the north pole of a magnet in the first magnetic assembly is directed toward the south pole of a magnet in the second magnetic assembly in an attractive configuration.

8. The magnetic separation device according to claim 7 wherein the first and second magnetic assemblies are configured such that a main volume of a sample vessel mounted within the each sample vessel retaining portion is subject to the magnetic field.

9. The magnetic separation device according to claim 7 wherein the first and second magnetic assemblies are configured such that a tip of a sample vessel mounted within the each sample vessel retaining portion is subject to the magnetic field.

10. The magnetic separation device according to claim 7 wherein at least one magnet of the plurality of magnets in each of the first and second magnetic assemblies are configured such that a substantial portion of a sample vessel mounted within the each sample vessel retaining portion is encompassed by magnetic material.

11. The magnetic separation device according to claim 10 wherein the at least one magnet comprises a concave face that is shaped at least approximately to conform to a certain portion of the sample vessel.

12. The magnetic separation device according to claim 7 further comprising a foot portion comprising a surface by which the body portion may stand on a supporting surface.

13. The magnetic separation device according to claim 12 wherein the foot portion is pivotally coupled to the body portion such that the body portion can operatively be tilted with respect to the vertical such that the each sample vessel retaining portion retains a respective sample vessel supported therein in a tilted position.

14. The magnetic separation device according to claim 7 wherein the body portion is configured such that the each sample vessel retaining portion is able to retain a sample vessel in a tilted position.

15. The magnetic separation device according to claim 7 wherein the each sample vessel retaining portion comprises at least one visible portion such that at least one portion of a sample vessel mounted in each sample vessel retaining portion is visible to a user.

16. The magnetic separation device according to claim 15 wherein the at least one visible portion is a portion extending at least substantially along the length of the sample vessel retaining portion.

17. The magnetic separation device according to claim 15 further comprising at least one light emitting diode to illuminate the at least one visible portion of the sample vessel retaining portion.

18. The magnetic separation device according to claim 15 further comprising at least one magnifying member to magnify a predetermined area of the at least one visible portion of the sample vessel retaining portion.

19. The magnetic separation device according to claim 7 wherein the each sample vessel retaining portion comprises:

a passage that extends at least substantially through the body portion of the sample vessel retaining portion from the aperture formed in the upper surface, wherein the aperture and passage are configured to receive and retain a sample vessel of a predetermined size.

20. The magnetic separation device according to claim 7 wherein the each sample vessel retaining portion comprises:

the aperture is of a first predetermined width;

a second aperture formed in a lower surface of the body portion of the sample vessel retaining portion of a second predetermined width; and a passage extending through the body portion of the sample vessel retaining portion between the aperture and the second aperture, wherein the first predetermined width of the aperture is the same as or different to the second predetermined width of the second aperture.

21. The magnetic separation device according to claim 20 whereby when the first predetermined width of the aperture is different to the second predetermined width of the second aperture, the device further comprises orientation means operable to orient the body portion of the sample vessel retaining portion between a first orientation and a second orientation, wherein:

in the first orientation, the body portion of the sample vessel retaining portion is orientated such that a sample vessel of a first predetermined width may be received and retained in the each sample vessel retaining portion via the first apertures, and in the second orientation, the body portion of the sample vessel retaining portion is orientated such that a sample vessel of a second predetermined width may be received and retained in the each sample vessel retaining portion via the second apertures.

22. The magnetic separation device according to claim 19 further comprising a sample vessel supporting member having a supporting portion, the member being movable between a first position and second position, wherein:

in the first position, said portion of the sample vessel supporting member is located within the passage of each sample vessel retaining portion in a position effective to support a sample vessel, and in the second position, said portion of the sample vessel supporting member is located outside the passage of each sample vessel retaining portion.

23. The magnetic separation device according to claim 7 further comprising an aperture defining element having a plurality of aperture defining portions wherein each aperture defining portion comprises a plurality of aperture segments of different predetermined sizes; whereby, the aperture defining element and the body portion are relatively movable between a range of positions and at any given position a selected aperture segment from each aperture defining portion is aligned with each sample vessel retaining portion.

* * * * *